US007615326B2

(12) United States Patent
Obata et al.

(10) Patent No.: US 7,615,326 B2
(45) Date of Patent: Nov. 10, 2009

(54) ELECTROPHOTOGRAPHIC PHOTOCONDUCTOR AND IMAGE FORMING APPARATUS

(75) Inventors: Takatsugu Obata, Nara (JP); Akihiro Kondoh, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 343 days.

(21) Appl. No.: 11/806,571

(22) Filed: Jun. 1, 2007

(65) Prior Publication Data

US 2007/0281229 A1 Dec. 6, 2007

(30) Foreign Application Priority Data

Jun. 2, 2006 (JP) ..... 2006-155055

(51) Int. Cl.
*G03G 5/047* (2006.01)

(52) U.S. Cl. ..... 430/58.85; 430/73; 399/159

(58) Field of Classification Search ..... 430/58.85, 430/73; 399/159
See application file for complete search history.

(56) References Cited

U.S. PATENT DOCUMENTS

| | | | | |
|---|---|---|---|---|
| 3,824,099 | A | 7/1974 | Champ et al. | |
| 4,123,269 | A | 10/1978 | Von Hoene et al. | |
| 4,150,987 | A | 4/1979 | Anderson et al. | |
| 4,367,273 | A | 1/1983 | Murayama et al. | |
| 4,892,949 | A | 1/1990 | Sasaki | |
| 5,550,293 | A * | 8/1996 | Shimada et al. | 564/426 |
| 2006/0275683 | A1 * | 12/2006 | Kondoh et al. | 430/58.85 |
| 2008/0166642 | A1 * | 7/2008 | Obata et al. | 430/58.7 |
| 2008/0286671 | A1 * | 11/2008 | Obata et al. | 430/58.35 |

FOREIGN PATENT DOCUMENTS

| | | |
|---|---|---|
| JP | 52-004188 | 1/1977 |
| JP | 54-150128 | 11/1979 |
| JP | 54-151955 | 11/1979 |
| JP | 55-052063 | 4/1980 |
| JP | 55-42380 | 10/1980 |
| JP | 58-32372 | 7/1983 |
| JP | 58-198043 | 11/1983 |
| JP | 02-190862 | 7/1990 |
| JP | 05-066587 | 3/1993 |
| JP | 2000-112157 | 4/2000 |
| JP | 2004-334125 | 11/2004 |

* cited by examiner

*Primary Examiner*—John L Goodrow
(74) *Attorney, Agent, or Firm*—Nixon & Vanderhye, P.C.

(57) ABSTRACT

A charge transporting substance having three stilbene structures or butadiene structures in a molecule, represented by the following general formula is used as an organic photoconductive material. An electrophotographic photoconductor is prepared by causing a photosensitive layer which is disposed on a conductive support, to contain the organic photoconductive material in order to dispose the photoconductor to an image forming apparatus.

(1)

8 Claims, 2 Drawing Sheets

ELECTROPHOTOGRAPHIC PHOTOCONDUCTOR AND IMAGE FORMING APPARATUS

CROSS-REFERENCES TO RELATED APPLICATION

This application is related to Japanese Patent Application No. 2006-155055 filed on 2 Jun., 2006, whose priority is claimed and the disclosure of which is incorporated by reference in its entirety.

BACKGROUND OF THE INVENTION

1. Field of the Invention

The present invention relates to an electrophotographic photoconductor using an organic photoconductive material, and an image forming apparatus.

2. Description of Related Art

In recent years, an organic photoconductive material has been extensively researched and developed and has been applied to an electrostatic recording element, a sensor material, an organic electro luminescent (Electro Luminescent: EL) element or the like in addition to being used for an electrophotographic photoconductor (hereinafter, simply referred to as photoconductor in some cases) in a field of copying machines.

Conventionally, in addition to the field of the copying machines, the electrophotographic photoconductor using the organic photoconductive material has been used in fields of printing materials, slide films, microfilms and the like, in which a photographic technique has been used. The electrophotographic photoconductor has been also applied to a high-speed printer in which a laser, a light emitting diode (Light Emitting Diode: LED), a cathode ray tube (Cathode Ray Tube: CRT) or the like is used as a light source.

Therefore, requirements for the organic photoconductive material and the electrophotographic photoconductor using the organic photoconductive material are getting-higher and more extensive.

Conventionally, an inorganic photoconductor has been used as the electrophotographic photoconductor, comprising a photosensitive layer mainly containing an inorganic photoconductive material such as selenium, zinc oxide, cadmium or the like.

However, the inorganic photoconductor has problems such as difficulty in forming the photosensitive layer, low plasticity, high production cost and others although the inorganic photoconductor has essential properties to a certain extent as the photoconductor.

Also, generally, the inorganic photoconductive material is highly toxic and has great restrictions in production and handling.

On the other hand, an organic photoconductor using the organic photoconductive material has advantageous points such as lightweight, high translucency, easiness of designing the photoconductor having fine sensitivity to wide-ranged wavelengths by an adequate sensitization method and others in addition to easiness in film formability of the photosensitive layer and excellent flexibility. Therefore, the organic photoconductor tends to be gradually developed as a main force of the electrophotographic photoconductor.

Although the organic photoconductor in early years has had disadvantageous points such as sensitivity and durability, these disadvantageous points have been remarkably improved by development of a function-separation type electrophotographic photoconductor in which a charge generating function and a charge transporting function are allotted to respectively different substances.

The function-separation type photoconductor has advantageous points that the option of selecting materials for a charge generating substance allotted for the charge generating function and a charge transporting substance allotted for the charge transporting function is wide and that the production of the electrophotographic photoconductor having desired characteristics is relatively easy.

As the charge generating substance to be used for such a function-separation type photoconductor have been investigated many kinds of substances such as phthalocyanine pigments, squarylium coloring materials, azo pigments, perylene pigments, polycyclic quinone pigments, cyanine coloring materials, squaric acid dyes and pyrylium type coloring materials, and various kinds of materials with high lightfastness and high charge generating capability have been proposed.

On the other hand, as the charge transporting substance have been known pyrazoline compounds (e.g. reference to Japanese Patent No. Sho 52-4188), hydrazone compounds (e.g. reference to Japanese Patent Application Laid-Open No. Sho 54-150128, Japanese Patent No. Sho 55-42380 and Japanese Patent Application Laid-Open No. Sho 55-52063), triphenylamine compounds (e.g. reference to Japanese Patent No. Sho 58-32372 and Japanese Patent Application Laid-Open No. Sho 54-151955), stilbene compounds (e.g. reference to Japanese Patent Application Laid-Open No. Sho 58-198043 and Japanese Patent Application Laid-Open No. Hei 2-190862) and the like.

Requirements for a charge transporting substance include:

(1) to be stable to light and heat;

(2) to be stable to active substances such as ozone, nitrogen oxide ($NO_x$), and nitric acid generated by corona discharge at the time of charging a photoconductor surface;

(3) to have high charge transporting capability;

(4) to have high compatibility with an organic solvent and a binding agent; and (5) to be produced easily at a low cost.

However, the charge transporting substances satisfy some of these requirements but cannot satisfy all of them at high level.

Among those five requirements, "to have the high charge transporting capability" of the item (3) is particularly required. This is because the charge transporting substance having the high charge transporting capability is required to obtain sufficient photo-response in the case of a charge transporting layer formed by dispersing the charge transporting substance with a binder resin being a surface layer of the photoconductor.

When the photoconductor is used on board of a copying machine, a laser beam printer or the like, a part of the surface layer of the photoconductor is unavoidably scraped by a contacting member such as a cleaning blade, a charging roller and the like. Therefore, for high durability of the copying machine and the laser beam printer, the strong surface layer of the photoconductor against the contacting member, that is, the surface layer which is hard to be abraded by scraping with the contacting member and which has high printing durability is required.

If the percentage of the binder resin content in the charge transporting layer which is the surface layer of the photoconductor is increased to improve reinforcement and durability of the surface layer, the photo-response of the charge transporting layer is decreased. This is because a ratio of the charge transporting substance in the charge transporting layer is lowered. That is, the charge transporting substance in the charge transporting layer is diluted as the percentage of the binder resin content is increased, and the photo-response of the charge transporting layer is deteriorated as a result of a decrease in the charge transporting capability of the charge transporting layer.

When the photo-response of the charge transporting layer is poor, residual potential rises and the photoconductor is used repeatedly in the state that surface potential is not sufficiently decayed. Therefore, a surface charge to be removed is not sufficiently eliminated by light exposure to result in undesirable consequence such as early deterioration of the quality of images.

Therefore, in order to obtain the sufficient photo-response, the charge transporting substance is required to have the high charge transporting capability.

Recently, the photoconductor has been required to have high sensitivity as a photoconductor characteristic corresponding to the demands for high speed as miniaturization and high speed of electrophotographic apparatuses such as digital copying machines and printers have been advanced. Also, it is required for the photoconductor to maintain sensitivity in a low-temperature environment and to ensure high reliability by controlling characteristic changes in various conditions.

Accordingly, the charge transporting substance is increasingly required to have high charge transporting capability. Also, in the high-speed process, since the time from exposure to development is short, it is required for the photoconductor to be excellent in the photo-response. However, as described above, since the photo-response depends on the charge transporting capability of the charge transporting substance, the charge transporting substance is required to have even higher charge transporting capability in terms of such a purpose.

Conventionally, as a purpose in developing the charge transporting substance satisfying the requirements has been molecularly designed in various forms and proposed compounds containing both the hydrazone structure and the styryl structure as compounds having more excellent capability in order to greatly expand a conjugated system in a basic structure (e.g. reference to Japanese Patent Application Laid-Open No. Hei 5-66587). However, if these compounds are used in a low-temperature environment, the sensitivity decreases, improvement is necessary in order for sufficient charge transporting capability, and the capability of the photoconductor is insufficient.

SUMMARY OF THE INVENTION

Accordingly, an object of the present invention is to provide an electrophotographic photoconductor having high durability as a result of increasing the amount of a binder resin by developing a charge transporting substance having characteristics such as high charging potential, high sensitivity, sufficient photo-response and high Hale transporting capability, and having high reliability for maintaining the characteristics even in a low-temperature environment or the high-speed process, and an image forming apparatus.

Inventors of the invention have intensively made various investigations, consequently have found that a photosensitive layer having high charging potential, high sensitivity, sufficient photo-response and high hale-transporting capability can be obtained by causing the photosensitive layer to contain a charge transporting substance as an organic photoconductive material, having a structure formed of expanded a conjugated system by containing three stilbene structures or butadiene structures in a molecule. Also, the inventors have come to complete that an electrophotographic photoconductor comprising the photosensitive layer containing the charge transporting substance, and an image forming apparatus are developed.

Accordingly, the present invention provides an electrophotographic photoconductor provided with a conductive support comprising a conductive material; and a photosensitive layer containing a charge generating substance provided on the conductive support and containing a charge transporting substance as a charge transporting material, in which the charge transporting substance is represented by the general formula (1):

(1)

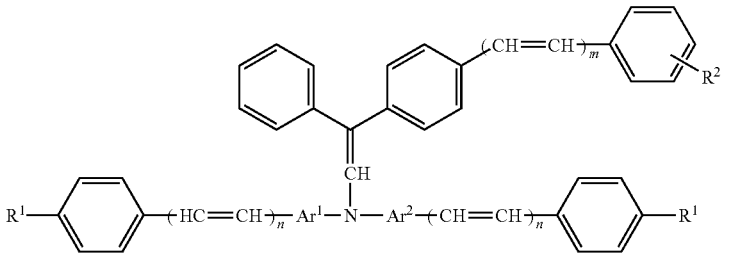

wherein $Ar^1$ and $Ar^2$ represent, independently of each other, an arylene group which may have substituent(s), $R^1$ represents an alkyl or alkoxy group which may have substituent(s), $R^2$ represents a hydrogen atom, an alkyl or alkoxy group which may have substituent(s), and n and m represent 1 or 2.

Also, the present invention provides an electrophotographic photoconductor in which the charge transporting substance as a specific example of the general formula (1) is represented by the following general formula (2):

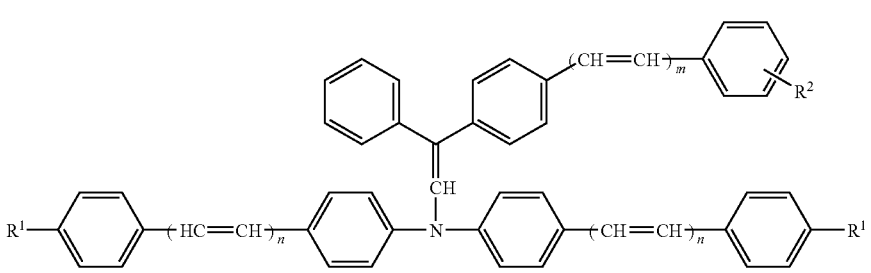

(2)

wherein $R^1$, $R^2$, n and m have the same meanings as defined in the above general formula (1), in which each of $Ar^1$ and $Ar^2$ in the above general formula (1) represents a phenylene group:

Further, the present invention provides an electrophotographic photoconductor in which the charge transporting substance as another specific example of the general formula (1) is represented by the following general formula (3):

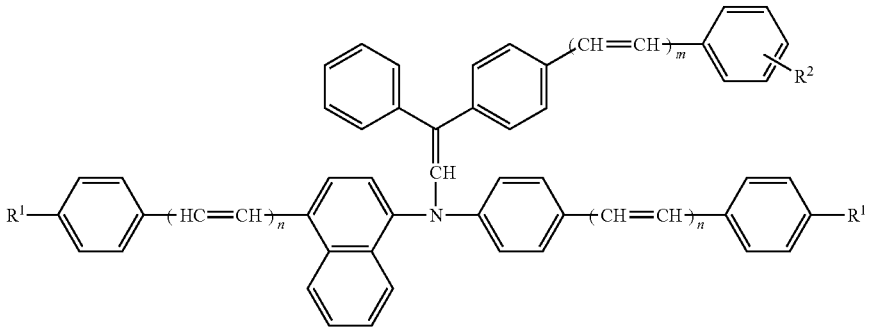

(3)

wherein $R^1$, $R^2$, n and m have the same meanings as defined in the above general formula (1), in which one of $Ar^1$ and $Ar^2$ in the above general formula (1) is a phenylene group and the other is a naphthylene group.

According to the present invention, the charge transporting substance can be used as the charge transporting material, which has the structure formed of the expanded a conjugated system by containing the structure represented by the above general formula (1), specifically by the above general formula (2), more-specifically by the above general formula (3), that is, three stilbene structures or butadiene structures in a molecule. By causing the photosensitive layer to contain these charge transporting substances as the organic photoconductive material, the photosensitive layer having characteristics such as high charging potential, high sensitivity, sufficient photo-response and high hale-transporting capability can be obtained.

The electrophotographic photoconductor having high durability as a result of increasing the amount of a binder resin by using the charge transporting substance which has the high hale-transporting capability, and having high reliability for maintaining the characteristics even in a low-temperature environment or the high-speed process, and the image forming apparatus can be obtained. Also, if the charge transporting substance is used for a sensor material, an EL element, an electrostatic recording element or the like, a device having an excellent response can be obtained.

DESCRIPTION OF THE PREFERRED EXAMPLES

Figure 1:
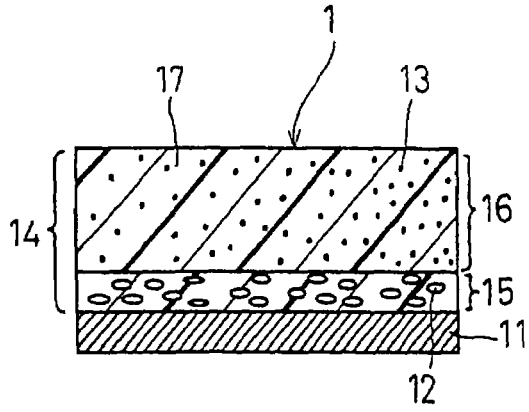
FIG. 1 is a partial cross-sectional view showing a simplified configuration of an electrophotographic photoconductor 1 of a first embodiment of the present invention.

The present invention is characterized in that an electrophotographic photoconductor contains a charge transporting substance having high hale-transporting capability as an organic photoconductive material, which is represented by any of the following general formulae (1), (2) and (3) as described above:

(1)

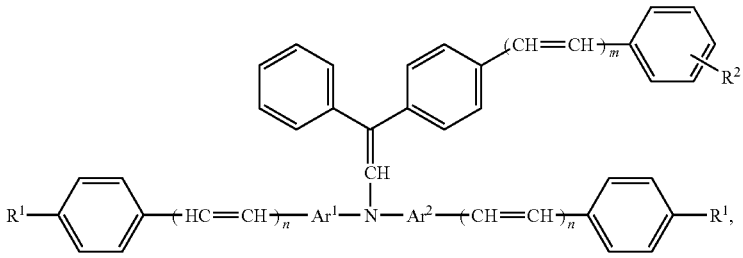

(2)

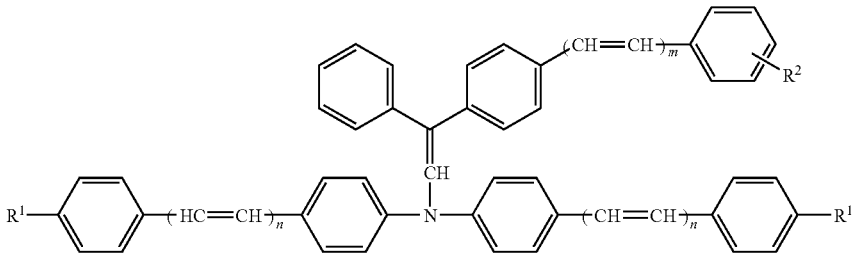

and (3)

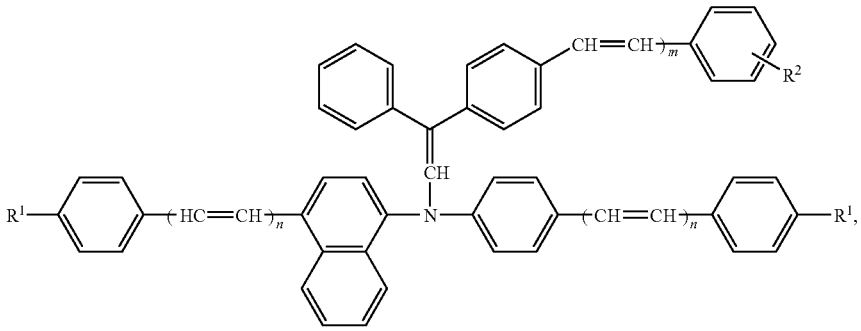

in which the charge transporting substance having three stilbene structures or butadiene structures in a molecule, and having a structure formed of expanded a conjugated system.

Examples of an arylene group optionally having substituent(s) defined as $Ar^1$ and $Ar^2$ of the above general formula (1) to be included may be p-phenylene, methyl-p-phenylene, m-phenylene, 1,4-naphthylene, 2,6-naphthylene, biphenylene and the like.

Further, $Ar^1$ and $Ar^2$ in the above general formula (1) may represent, independently of each other, the same groups selected from the arylene group, such as p-phenylene, 1,4-naphthylene or the like. Also, $Ar^1$ and $Ar^2$ may be, different from each other, and may represent two different groups selected from the above arylene group such that one of $Ar^1$ and $Ar^2$ may represent the p-phenylene group and the other may represent 1,4-naphthylene.

Examples of an alkyl group optionally having substituent(s) defined as $R^1$ or $R^2$ of the above general formulas (1) to (3) to be included may be methyl, ethyl, n-propyl, isopropyl, t-butyl, trifluoromethyl, 2-fluoroethyl, 2,2,2-trifluoroethyl, 1-methoxyethyl group and the like.

Similarly, examples of an alkoxy group optionally having substituent(s) defined as $R^1$ or $R^2$ of the above general formulas (1) to (3) to be included may be methoxy, ethoxy, n-propoxy, isopropoxy, 2-fluoroethoxy group and the like.

In the present invention, the charge transporting substance represented by the above general formula (1) which is contained in the photosensitive layer is a novel compound and can be prepared as described below.

For example, a bisstilbene or a bisbutadiene compound represented by the following general formula (4):

(4)

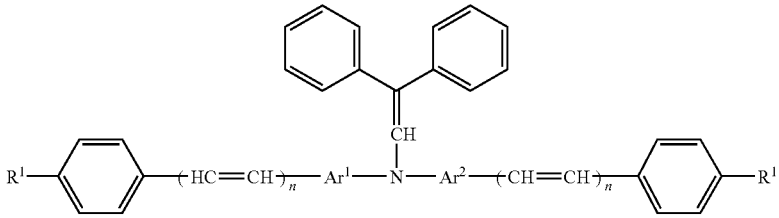

wherein $Ar^1$, $Ar^2$, $R^1$ and n have the same meanings as defined in the above general formula (1), is synthesized according to a method described in Japanese Patent No. 3580426 or Japanese Patent Application Laid-Open No. 2000-112157.

Next, the compound represented by the above general formula (4) is formylated by a Vilsmeier reaction to give an aldehyde compound represented by the general formula (5):

(5)

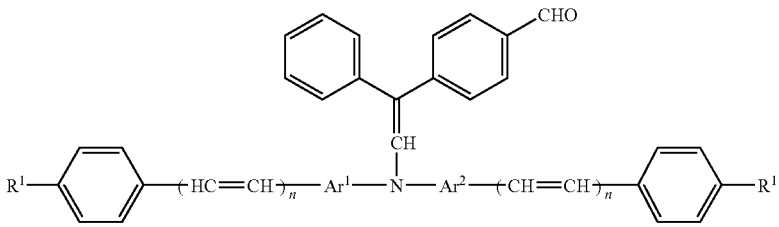

wherein $Ar^1$, $Ar^2$, $R^1$ and n have the same meanings as defined in the above general formula (1).

Next, the charge transporting substance represented by the following general formula (1):

(1)

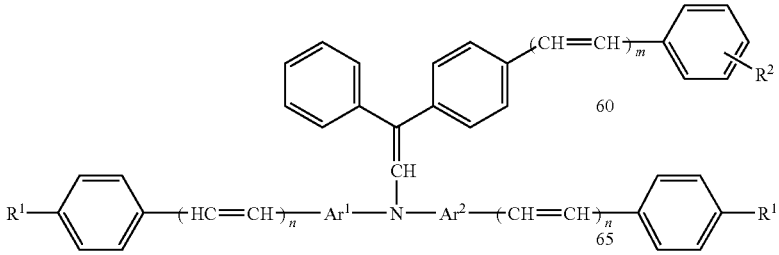

wherein $Ar^1$, $Ar^2$, $R^1$, $R^2$, n and m are as defined above, can be prepared by reacting the aldehyde compound represented by the above general formula (5) with a Wittig reagent represented by the following general formula (6):

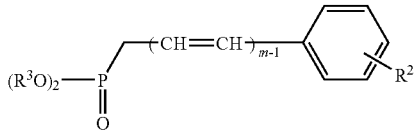

(6)

wherein $R^2$ and m have the same meanings as defined in the above general formula (1) and $R^3$ represents an alkyl group or an aryl group which may have substituent(s), by a Wittig-Horner reaction in a basic condition known to persons skilled in the art.

The Vilsmeier reaction, for example, can be carried out as below.

First, phosphorus oxychloride and N,N-dimethylformamide, phosphorus oxychloride and N-methyl-N-phenylformamide, or phosphorus oxychloride and N,N-diphenylformamide are added to a solvent such as N,N-dimethylformamide (DMF), 1,2-dichloroethane or the like in order to prepare a Vilsmeier reagent according to a known method.

Secondly, 1.0 equivalent of the bisstilbene or the bisbutadiene compound represented by the above general formula (4) is added to 1.0 to 1.3 equivalents of the prepared Vilsmeier reagent and is stirred at 60 to 110° C. for 2 to 8 hours. Then, the alkaline hydrolysis is carried out by using a 1 to 8 normal sodium hydroxide or potassium hydroxide aqueous solution or the like.

By the alkaline hydrolysis, a high yield of the aldehyde compound represented by the above general formula (5) can be produced.

The Wittig reaction, for example, can be carried out as below.

A high yield of the charge transporting substance represented by the above general formula (1) can be produced by stirring 1.0 equivalent of the aldehyde compound represented by the above general formula (5), 1.0 to 1.2 equivalents of the Wittig reagent represented by the above general formula (6), and 1.0 to 1.5 equivalents of metal alkoxide in a proper solvent at room temperature or 30 to 60° C. for 2 to 8 hours.

A solvent for the above Wittig-Horner reaction to be used may be toluene, xylene, diethylether, tetrahydrofuran (THF), ethyleneglycoldimethylether, N,N-dimethylformamide, dimethylsulfoxide (DMSO) or the like.

Also, the above metal alkoxide to be included may be potassium-t-butoxide, sodium ethoxide, sodium methoxide or the like.

Examples of the charge transporting substance prepared by the above method are shown in Table 1 below.

Since any charge transporting substance prepared by such a method is formed of expanded a conjugated system having three stilbene structures or butadiene structures, the charge transporting substance has high charge transportability. By using the charge transporting substance of the present invention having such a high charge transportability as the organic photoconductive material, an electrophotographic photoconductor having high charging potential, high sensitivity, sufficient photo-response, high durability and high reliability for maintaining the characteristics even in a low-temperature environment or in the high-speed process, can be obtained.

Also, the present invention provides an electrophotographic photoconductor as the charge generating substance, characterized in that oxotitanium phthalocyanine is contained as the charge generating substance, which has at least 27.2° of diffraction peak at the Bragg angle (2θ±0.2°) in the Cu—Kα characteristic X-ray diffraction (wavelengths: 1.54 Å).

Oxotitanium phthalocyanine having at least 27.2° of diffraction peak at the Bragg angle (2θ±0.2°) in the Cu—Kα characteristic X-ray diffraction (wavelengths: 1.54 Å) has high charge generating efficiency and charge injection efficiency. The charge generating substance such as above can generate a large quantity of electric charge by the light absorption as well as being able to efficiently inject the generated electric charge into the charge transporting substance without accumulating the generated charge in the charge generating substance.

Also, the photosensitive layer contains the charge transporting substance having the high charge transportability represented by the above general formulas (1) to (3), as the organic photoconductive material.

Therefore, the electric charge generated from the charge generating substance by the light absorption can obtain the electrophotographic photoconductor having the high sensitivity and the high resolution because the charge is efficiently injected into the charge transporting substance and is efficiently transported.

Also, the present invention provides an electrophotographic photoconductor characterized by containing a layered structure of a charge generating layer in which the photosensitive layer contains the charge generating substance, and a charge transporting layer in which the photosensitive layer contains the charge transporting substance.

As a result, by allotting a charge generating function and a charge transporting function to respectively different layers, respectively adequate materials can be selected for the charge generating function and the charge transporting function. Consequently, the electrophotographic photoconductor having the higher sensitivity and the higher durability with the improved stability when used repeatedly, can be obtained.

Further, the present invention provides an electrophotographic photoconductor characterized in that the charge transporting layer further contains the binder resin, and a weight ratio A/B between the charge transporting substance (A) and the binder resin (B) is 10/12 to 10/30.

The photosensitive layer of the present invention can maintain the excellent photo-response as the organic photoconductive material even though a higher ratio of the binder resin is added to the charge transporting layer, since the contained charge transporting substance of the present invention has higher charge transportability than the conventional charge transporting substance.

Therefore, the durability of the electrophotographic photoconductor can be further improved by a multiplier effect of improved printing durability without lowering the photo-response and excellent abrasion resistance of the organic photoconductive material itself.

Furthermore, the present invention provides an electrophotographic photoconductor characterized in that an intermediate layer is provided between the conductive support and the photosensitive layer.

Since the intermediate layer can prevent the electric charge from injecting from the conductive support to the photosensitive layer, it can prevent electrostatic property of the photosensitive layer from lowering, suppress a decrease in a surface charge other than one which should be deleted by the exposure to light, and prevent the image from generating a defect such as fog density and others. Also, since the provided intermediate layer can form a uniform surface by covering the surface of the conductive support which has defect(s) thereon, film formability of the photosensitive layer can be improved. Further, the provided intermediate layer also suppresses exfoliation of the photosensitive layer from the conductive support and improves adhesive capacity between the conductive support and the photosensitive layer.

The present invention is characterized in that an electrophotographic photoconductor is provided with the photosensitive layer containing the charge transporting substance as the organic photoconductive material, represented by the above general formula (1), (2) or (3).

Although the photosensitive layer of the present invention may be a layer containing the charge generating substance and the charge transporting substance, it may have a layered structure in which the charge generating layer and the charge transporting layer are laminated as described above, and it may be in various forms.

In addition, the present invention provides an image forming apparatus characterized by containing the electrophotographic photoconductor.

According to the present invention, since the electrophotographic photoconductor having the high charging potential, the high sensitivity, the sufficient photo-response, the high durability and stable levels of these characteristics in the low-temperature environment and in the high-speed process is provided, an image forming apparatus having the high reliability which can provide a high-quality image even in various conditions can be obtained.

The following are embodiments of the present invention as referring to figures attached.

Figure 2:
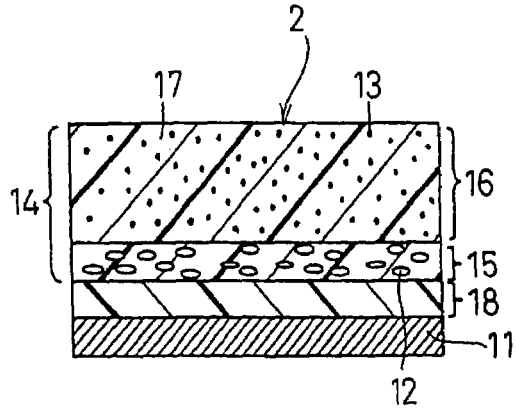
FIG. 2 is a partial cross-sectional view showing a simplified configuration of an electrophotographic photoconductor 2 of a second embodiment of the present invention.
Figure 3:
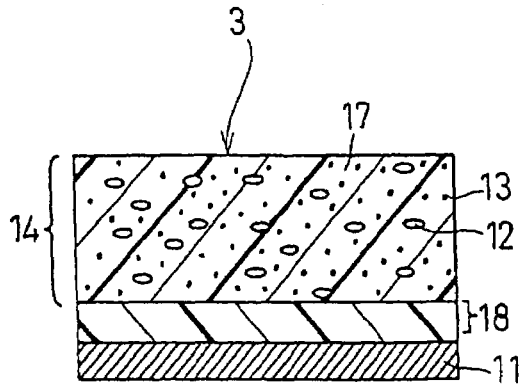
FIG. 3 is a partial cross-sectional view showing a simplified configuration of an electrophotographic photoconductor 3 of a third embodiment of the present invention.
Figure 4:
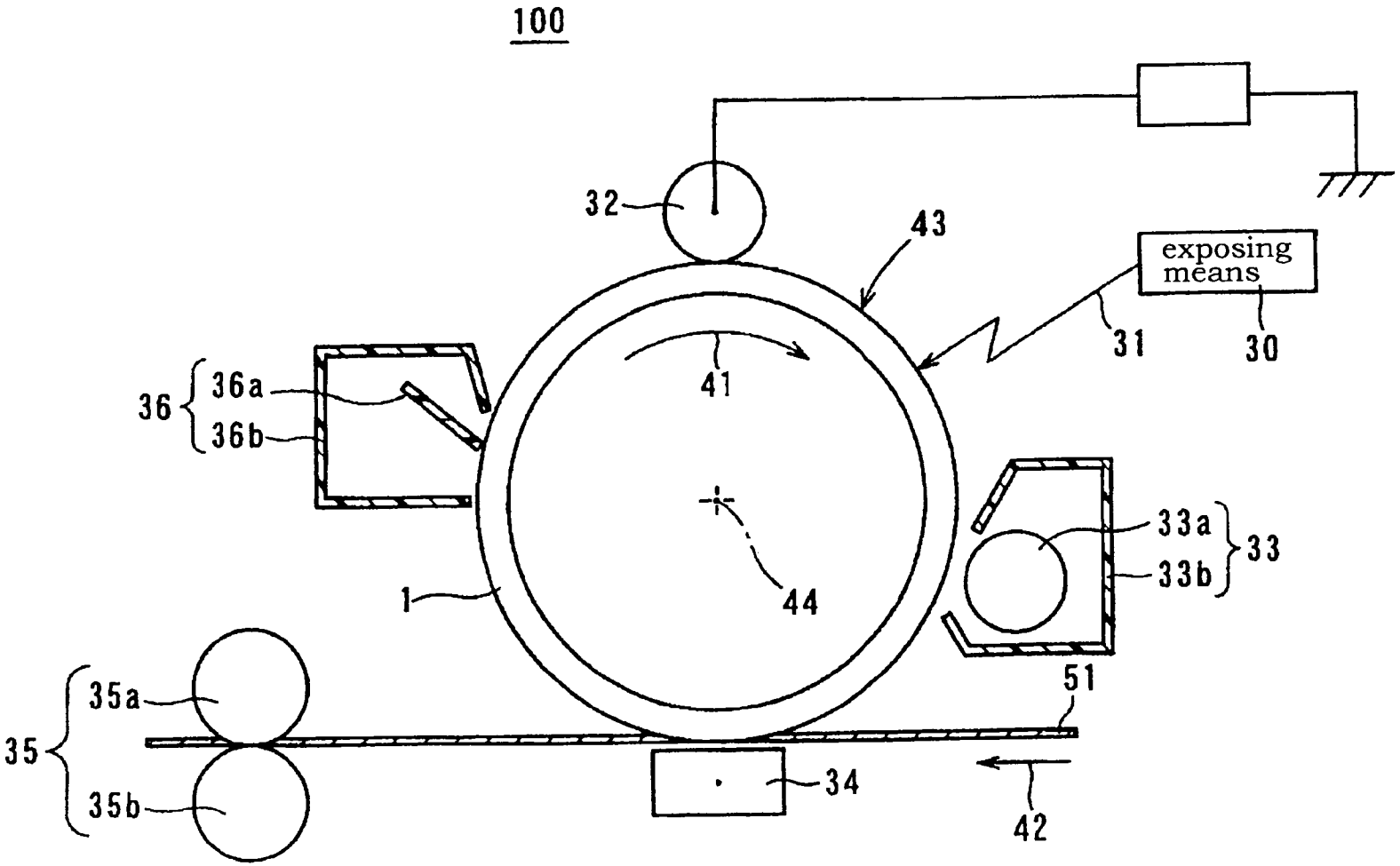
FIG. 4 is a side face drawing of a configuration illustrating a simplified image formation apparatus 100 of an embodiment of an image forming apparatus of the present invention.

FIGS. 1 to 3 are simplified cross-sectional views of an electrophotographic photoconductor as examples of embodiments of the present invention. Also, FIG. 4 is a simplified cross-sectional view of an image forming apparatus comprising an electrophotographic photoconductor set forth in the present invention.

Incidentally, the electrophotographic photoconductor, and the image forming apparatus are not limited to the embodiments and may naturally change within a range of essential subjects which do not deviate from a main issue.

Embodiment 1

FIG. 1 is a partial cross-sectional view showing a simplified configuration of an electrophotographic photoconductor 1 of a first embodiment of the present invention.

The electrophotographic photoconductor 1 contains a sheet-like conductive support 11 comprising a conductive material, a charge generating layer 15 containing a charge generating substance 12, which is laminated on the conductive support 11, and a charge transporting layer 16 containing a charge transporting substance 13, which is laminated on the charge generating layer 15. The charge generating layer 15 and the charge transporting layer 16 constitute a layered-type photoconductive layer 14 which is a photosensitive layer. That is, the photoconductor 1 is a layered-type photoconductor.

The conductive support 11 works as an electrode of the photoconductor 1 and also works as a support member for each of the layers 15 and 16. The shape of the conductive support 11 is, however, sheet-like in this embodiment, it is not limited to that and may be like a column, cylindrical or an endless belt.

The conductive material composing the conductive support 11 of the present invention to be used may be a metal single substance such as aluminum, copper, zinc, and titanium, and an alloy such as an aluminum alloy and stainless steel.

Also, the conductive material is not limited to these metal materials and may be a macromolecular material such as polyethylene terephthalate, nylon, polystyrene or the like. Further, the conductive material may be used for a surface of hard paper or glass by using a metal foil laminated thereon, a metal material which is vapor deposited thereon, or a layer of a conductive compound such as conductive macromolecule, tin oxide, indium oxide or the like, which is vapor deposited or coated thereon. These conductive materials may be used by being machined into a prescribed shape.

If necessary, the surface of the conductive support 11 may be subjected to diffused reflection treatment by anodization coating treatment, surface treatment by a chemical, hot water or the like, coloration treatment, or surface roughening within a range not affecting image quality.

In an electrophotographic process using laser as an exposure light source, since the waveform of the laser beam is even, the laser beam reflected on the photoconductor surface and the laser beam reflected in the inside of the photoconductor are interfered and an interference fringe by the interference sometimes appears on an image to cause an image defect. The image defect due to the interference of the laser beam with the uniform waveform can be prevented by execution of the treatment for the surface of the conductive support 11.

The charge generating layer 15 provided on the conductive support 11 contains the charge generating substance 12 which generates electric charge by the light absorption.

The charge generating substance may include the organic photoconductive material, for example, azo type pigments such as monoazo type pigments, bisazo type pigments, and trisazo type pigments; indigo type pigments such as indigo and thioindigo; perylene type pigments such as peryleneimide and perylenic acid anhydride; polycyclic quinone type pigments such as anthraquinone and pyrenequinone; phthalocyanine compounds such as metal phthalocyanine like oxotitanium phthalocyanine and non-metal phthalocyanine; squarylium coloring materials; pyrylium type salts and thiopyrylium salts; and triphenylmethane type coloring materials, and the inorganic photoconductive material such as selenium and amorphous silicon.

These charge generating substances may be used alone or two or more of them may be used in form of a mixture.

Among these charge generating substances, the phthalocyanine compounds are preferable and particularly, it is preferable to use the oxotitanium phthalocyanine compounds.

The oxotitanium phthalocyanine compounds used in the present invention indicate oxotitanium phthalocyanine and derivatives thereof.

The oxotitanium phthalocyanine derivatives in which a hydrogen atom of an aromatic ring contained in a phthalocyanine group of oxotitanium phthalocyanine is substituted with a substituent including a halogen atom such as a chlorine atom or a fluorine atom, a nitro group, a cyano group, a sulfonic acid group or the like; and a ligand such as a chloride atom or the like is coordinated with a titanium atom which is a center metal of oxotitanium phthalocyanine, are included.

The oxotitanium phthalocyanine compound is desirable to have a specific crystalline structure. The desirable oxotitanium phthalocyanine has the crystalline structure having al least 27.2° of diffraction peak at the Bragg angle 2θ (an error: 2θ±0.20) in an X-ray diffraction spectrum with respect to the Cu—Kα characteristic X-ray (wavelengths: 1.54 Å), is included. Also, the Bragg angle 2θ means an angle formed with an incident X-ray and a diffraction X-ray, that is, a diffraction angle.

When the oxotitanium phthalocyanine compound is used as the charge generating substance and the charge transporting substance represented by the above general formula (1) is used as an organic photoconductive material, is more preferable to obtain a photoconductor having the excellent sensitivity and the excellent resolution degree.

That is, since the above oxotitanium phthalocyanine compound has excellent charge generating capability and charge injection capability, the compound can generate a large quantity of the electric charge by the light absorption as well as being able to efficiently inject the generated electric charge into the charge transporting layer 16 without accumulating the generated charge in the inside of the charge generating layer.

Also, as described above, the charge transporting substance having high charge transportability represented by the above general formula (1), (2) or (3) is used as an organic photoconductive material for the charge transporting substance 13. Therefore, the electric charge generated by the charge generating substance 12 by the light absorption can obtain an electrophotographic photoconductor having the high sensitivity and the high resolution degree since the electric charge is efficiently injected into the charge transporting substance 13 and smoothly transported.

The oxotitanium phthalocyanine can be produced by conventionally known production methods such as a method described in Moser and Thomas, "Phthalocyanine Compounds, Reinhold Publishing Corp., New York, 1963.

An example of oxotitanium phthalocyanine can be produced by heating and melting phthalonitrile and titanium tetrachloride or causing thermal reaction of phthalonitrile and titanium tetrachloride in a proper solvent such as α-chloronaphthalene for synthesizing dichlorotitanium phthalocyanine and then hydrolyzing dichlorotitanium phthalocyanine in a base or water.

Oxotitanium phthalocyanine can be produced by causing thermal reaction of isoindoline with titanium tetraalkoxide such as tetrabutoxytitanium in a proper solvent such as N-methylpyrrolidone.

The charge generating substance used in the present invention may be used with another sensitizing dye.

The sensitizing dye may include triphenylmethane type dyes represented by Methyl Violet, Crystal Violet, Night Blue, and Victoria Blue; acridine dyes represented by erythrosine, Rhodamine B, Rhodamine 3R, Acridine Orange, and Flaveosine; thiazine dyes represented by Methylene Blue and Methylene Green; oxazine dyes represented by Capryl Blue and Meldras Blue; cyanine dyes; styryl dyes; pyrylium dyes and thiopyrylium dyes.

The charge generating layer 15 may contain a binder resin in order to improve binding capacity.

Examples for the binder resin may include resins such as polyester resin, polystyrene resin, polyurethane resin, phenol resin, alkyd resin, melamine resin, epoxy resin, silicone resin, acrylic resin, methacrylic resin, polycarbonate resin, polyarylate resin, phenoxy resin, polyvinyl butyral resin, and polyvinylformal resin; and copolymer resins containing two or more repeating units composing these resins.

Practical examples of the copolymer resins may include insulating resins such as vinyl chloride-vinyl acetate copolymer resin, vinyl chloride-vinyl acetate-maleic anhydride copolymer resin, and acrylonitrile-styrene copolymer resin. The binder resins are not limited to these exemplified resins but may be commonly employed resins. The binder resins may be used alone or two or more of them may be used in form of a mixture.

The quantity of the charge generating substance in the charge generating layer 15 is desirable to be 10 wt % or more and 99 wt % or less. If the quantity of the charge generating substance is less than 10 wt %, there is the possibility of a decrease in the sensitivity of the photoconductor. Also, if the quantity of the charge generating substance is more than 99 wt %, there is the possibility of a decrease in the film strength of the charge generating layer 15 due to the excessively low content of the binder resin. Further, there is also the possibility of a decrease in the dispersibility of the charge generating substance in the charge generating layer 15 to increase coarse particles of the charge generating substance, so that a surface charge in a portion other than a portion to be eliminated by the exposure is lowered to result in image defects and particularly in an increase in fogging of images, so-called black flickers, due to deposition of a toner in very small black points in white background.

A method for forming the charge generating layer 15 may be a vapor deposition method in which the charge generating substance is deposited on the surface of the conductive support 11 by vacuum deposition or a coating method in which a coating solution for the charge generating layer containing the charge generating substance is applied to the surface of the conductive support 11. Among them, a simple coating method is preferably used.

The coating solution for the charge generating layer can be prepared, for example, by adding the charge generating substance and the binder resins if necessary to a proper solvent, and dispersing the binder resins in the solvent by a conventionally known method.

Examples to be used as the solvent for the coating solution for the charge generating layer are halogenated hydrocarbons such as dichloromethane and dichloroethane; ketones such as acetone, methyl ethyl ketone, and cyclohexanone; esters such as ethyl acetate and butyl acetate; ethers such as tetrahydrofuran and dioxane; alkyl ethers of ethylene glycol such as 1,2-dimethoxyethane; aromatic hydrocarbons such as benzene, toluene, and xylene; and aprotic polar solvents such as N,N-dimethylformamide and N,N-dimethylacetamide. These solvents may be used alone or two or more of them may be used in form of a mixture.

The charge generating substance may be crushed by a crusher before it is dispersed in the solvent. Examples to be used as the crusher for the crushing treatment may be a ball mill, a sand mill, an attriter, a shaking mill, and an ultrasonic dispersing apparatus.

Examples to be used as the dispersing apparatus at the time of dispersing the charge generating substance in the solvent may be a paint shaker, a ball mill, and a sand mill. The dispersion conditions at the time may be selected properly so as to prevent contamination with impurities due to abrasion of containers to be used and the components of the dispersing apparatus.

The coating method of the coating solution for the charge generating layer may be, for example, a spray method, a bar coating method, a roll coating method, a blade method, a ring coating method, and an immersion coating method.

Especially, the immersion coating method among the coating methods is a method for forming a layer on the surface of a substrate by immersing the substrate in a coating bath filled with a coating solution and successively pulling up the substrate at a constant speed or gradually changed speed and is relatively simple and excellent in the productivity and the cost and therefore the method is preferably used.

An apparatus to be used for the immersion coating method may be equipped with a coating solution dispersion apparatus represented by an ultrasonic generating apparatus for stabilizing dispersibility of the coating solution. Also, the coating method is not limited to these methods and an optimum method may be selected among these coating methods in consideration of physical properties and productivity of the coating solution.

A thickness of the charge generating layer 15 is preferable in a range from 0.05 μm or thicker to 5 μm or thinner, and more preferable in a range from 0.1 μm or thicker to 1 μm or thinner. If the thickness of the charge generating layer 15 is thinner than 0.05 μm, there is the possibility of a decrease in the light absorption efficiency to lower the sensitivity of the photoconductor 1. Also, if the thickness of the charge generating layer 15 exceeds 5 μm, there is the possibility that the charge transfer in the inside of the charge generating layer 15 becomes a speed control step in the elimination of the surface charge of the photosensitive layer 14 to lower the sensitivity of the photoconductor 1.

Addition of the charge transporting substance 13 represented by the above general formula (1), (2) or (3) as an organic photoconductive material having capacity to accept and transport the electric charge generated by the charge generating substance 12 to the binder resin 17 makes it possible to obtain the charge transporting layer 16.

The charge transporting substance represented by the above general formula (1), (2) or (3) may be used alone or two or more of them may be used in form of a mixture, the charge transporting substance selected from a group comprising Example Compounds 1 to 52 shown in Table 1 below.

The organic photoconductive material represented by the above general formula (1), (2) or (3) may be mixed with the other charge transporting substance, respectively.

Examples of the other charge transporting substance to be used may be carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, polycyclic aromatic compounds, indole derivatives, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, triarylmethane derivatives, phenylenediamine derivatives, stilbene derivatives, and benzidine derivatives.

Also, polymers having groups derived from the above-exemplified compounds in main chains or side chains, for example, poly-N-vinylcarbazole, poly-1-vinylpyrene and poly-9-vinylanthracene are exemplified.

However, the charge transporting substance of the present invention represented by the above general formula (1), (2) or (3) is desirable to be used as the organic photoconductive material for the charge transporting substance 13 in order to obtain particularly high charge transporting capability.

The binder resin 17 forming the charge transporting layer 16, which has compatibility with the charge transporting substance 13 is selected.

Examples of the binder resin to be used may be vinyl polymer resins such as polymethyl methacrylate resin, polystyrene resin, and polyvinyl chloride resin; copolymer resin containing two or more repeating units composing the vinyl polymer resins; polycarbonate resin; polyester resin; polyester carbonate resin; polysulfone resin; phenoxy resin; epoxy resin; silicone resin; polyarylate resin; polyamide resin; polyether resin; polyurethane resin; polyacrylamide resin; and phenol resin. Thermosetting resin obtained by partially crosslinking these resins may also be included. These resins may be used alone or two or more of them may be used in form of a mixture.

Among the above resins, polystyrene resin, polycarbonate resin, polyarylate resin or polyphenylene oxide is preferably used since these resins have the volume resistivity of $10^{13}\Omega\cdot$cm or more, excellent electric insulation properties, or excellent coating properties and electrical potential properties.

A weight ratio (B/A) of a weight of the binder resin (B) to a weight of the charge transporting substance (A) represented by the general formula (1), (2) or (3) in the charge transporting layer 16 is desirably in a range from 1.2 or higher to 3.0 or lower. When the ratio B/A is 1.2 or higher and the charge transporting layer 16 contains the high ratio of the binder resin, printing durability of the charge transporting layer 16 can be improved.

However, if the ratio of the binder resin is set to be high, the percentage of the charge transporting substance content is eventually lowered. If the weight ratio (the binder resin/the charge transporting substance) of the weight of the binder resin to the weight of the charge transporting substance in the charge transporting layer 16 is similarly set to be 1.2 or higher by using a conventionally known charge transporting substance, it may result in a decrease in the photo-response of the photoconductor and the image defect.

On the other hand, the charge transporting substance of the present invention represented by the general formula (1), (2) or (3) can provide the sufficiently high photo-response and the high-quality image of the photoconductor 1 since the substance has the particularly excellent charge transporting capability although the ratio B/A is set to be 1.2 or higher and the ratio of the binder resin in the charge transporting layer 16 is set to be high. Therefore, the photoconductor 1 can improve the printing durability of the charge transporting layer 16 at the ratio B/A of 1.2 or higher to result in high mechanical durability without decreasing the photo-response.

If the ratio B/A exceeds 3.0, there is the possibility of a decrease in the sensitivity of the photoconductor 1 due to the excessively high ratio of the binder resin. If the ratio B/A exceeds 3.0 by forming the charge transporting layer 16 by an immerse coating method, there is the possibility of a significant decrease in the productivity due to increased viscosity of the coating solution to result in a coating speed.

On the other hand, if the solvent of the coating solution is increased to suppress an increase in the viscosity of the coating solution, there is the possibility of causing a brushing phenomenon and cloudiness in the charge transporting layer 16.

Also, if the ratio B/A is lower than 1.2, there is the possibility of a decrease in chargeability of the photoconductor 1 due to the excessively low ratio of the binder resin and an increase in the amount of a film of the photosensitive layer 14 by the low printing durability of the charge transporting layer 16.

If necessary, an additive such as a plasticizer, a leveling agent or the like may be added to the charge transporting layer 16 in order to improve film formability, flexibility and surface smoothness.

The plasticizer may include dibasic acid esters such as phthalic acid esters, fatty acid esters, phosphoric acid esters, chlorinated paraffins, and epoxy type plasticizers.

The leveling agent may include silicone type leveling agents such as dimethyl silicone, diphenyl silicone, and phenylmethyl silicone.

Also, fine particles of inorganic compounds or organic compounds may be added to the charge transporting layer 16 in order to strengthen the mechanical strength and improve the electrical properties.

Specific examples of such inorganic compounds may include metal oxide fine particles such as titanium oxide. Also, specific examples of the fine particles of organic compounds may include fluorine atom-containing polymer fine particles such as tetrafluoroethylene polymer fine particles.

Further, if necessary, the charge transporting layer 16 may contain various kinds of additives such as an antioxidant and a sensitizer. By doing so, the electrical potential properties of the charge transporting layer 16 are improved as well as stability of the charge transporting layer 16 as the coating solution is increased and at the same time fatigue deterioration is decreased to improve the durability when the photoconductor is repeatedly used.

Examples to be desirably used as the antioxidant may be hindered phenol derivatives and hindered amine derivatives. When the hindered phenol derivatives or the hindered amine derivatives are used alone, each of the derivatives is desirable to be used in a range from 0.1 wt % or more to 50 wt % or less for the charge transporting substance 13.

Also, the hindered phenol derivatives and the hindered amine derivatives may be mixed and used at the optional rate. In this case, a total use amount of the hindered phenol derivatives and the hindered amine derivatives is desirable to be in a range from 0.1 wt % or more to 50 wt % or less for the charge transporting substance 13. If a use amount of the hindered phenol derivatives, a use amount of the hindered amine derivatives, or the total use amount of the hindered phenol derivatives and the hindered amine derivatives is less than 0.1 wt %, sufficient effects of improving the stability of the coating solution and the durability of the photoconductor cannot be obtained. Also, if 50 wt % is exceeded, it may cause adverse effects on photoconductor properties.

In the same manner as the case of forming the charge generating layer 15, the charge transporting layer 16 is formed by applying the coating solution to the charge generating layer 15 by a spray method, a bar coating method, a roll coating method, a blade method, a ring coating method, or an immersion coating method, the coating solution for the charge transporting layer prepared by dissolving or dispersing the charge transporting substance 13 and the binder resin 17 in a proper solvent with the above additive, if necessary. Especially, the immersion coating method among the coating methods is excellent in various points as described above and therefore it is employed most frequently for forming the charge transporting layer 16.

The solvent to be used for the coating solution for the charge transporting layer may be aromatic hydrocarbon such as benzene, toluene, xylene, and monochlorobenzene; halogenated hydrocarbon such as dichloromethane and dichloroethane; ethers such as THF, dioxane, and dimethoxymethyl ether; and aprotic polar solvents such as N,N-dimethylformamide. These solvents may be used alone or two or more of them may be used in form of a mixture.

The solvent may be also used while being mixed with a solvent such as alcohol, acetonitrile, or methyl ethyl ketone if necessary.

A thickness of the charge transporting layer 16 is preferable in a range from 5 μm or thicker to 50 μm or thinner, and more preferable in a range from 10 μm or thicker to 40 μm or thinner.

If the thickness of the charge transporting layer 16 is thinner than 5 μm, there is the possibility of a decrease in charge retaining capability of the photoconductor surface. If the thickness of the charge transporting layer 16 exceeds 50 μm, there is the possibility of a decrease in resolution degree of the photoconductor 1.

The photosensitive layer 14 of the present invention has a layered structure formed by laminating the charge generating layer 15 and the charge transporting layer 16 which are formed as described above. By allotting the charge generating function and the charge transporting function to respectively different layers, materials respectively forming the layers can be independently selected; therefore, adequate materials can be respectively selected for the charge generating function and the charge transporting function. Accordingly, the photoconductor 1 is particularly excellent in the electrical properties such as the chargeability, the sensitivity and the photoresponse, and also the electrical and mechanical durability.

One or more sensitizers such as an electron acceptor substance and a coloring material may be added to each layer of the photosensitive layer 14, that is, the charge generating layer 15 and the charge transporting layer 16, within a range not damaging desirable properties of the present invention.

The sensitivity of the photoconductor is improved by adding the sensitizers, and further the electrical durability of the photoconductor is improved by suppressing increase and fatigue of the residual potential caused by repeat use.

Examples of the electron acceptor substance to be used are acid anhydride such as succinic anhydride, maleic anhydride, phthalic anhydride, and 4-chlorophthalic anhydride; a cyano compound such as tetracyanoethylene and terephthalomalondinitrile; aldehyde such as 4-nitrobenzaldehyde; anthraquinones such as anthraquinone and 1-nitoranthraquinone; a polycyclic or a heterocyclic nitro compound such as 2,4,7-trinitrofluorenone and 2,4,5,7-tetranitrofluorenone; and an electron attractive material such as a diphenoquinone compound. Also, a polymerized compound of these electron attractive materials is also usable.

As the sensitizer such as the coloring material can be used an organic photoconductive compound such as xanthene type coloring materials, thiazine type coloring materials, triphenylmethane type coloring materials, quinoline type pigments, and copper phthalocyanine. These organic photoconductive compounds work as an optical sensitizer.

Embodiment 2

FIG. 2 is a partial cross-sectional view showing a simplified configuration of an electrophotographic photoconductor 2 of a second embodiment of the present invention. With respect to the electrophotographic photoconductor 2 of this embodiment, same symbols are assigned to the parts similar and corresponding to those of the electrophotographic photoconductor 1 of the first embodiment and their explanations will be omitted.

An outstanding point in the electrophotographic photoconductor 2 is that an intermediate layer 18 is provided between the conductive support 11 and the photosensitive layer 14.

In the case where no intermediate layer 18 is provided between the conductive support 11 and the photosensitive layer 14, the electric charge is injected into the photosensitive layer 14 from the conductive support 11 and it leads to a decrease in the chargeability of the photosensitive layer 14, a decrease in the surface charge in a portion other than portions to be exposed, and occurrence of defects such as fogging in the image in some cases. Particularly, in the case of forming an image by a reverse development process, the toner image is formed by toner adhering to parts where the surface charge is decreased by the exposure. If the surface charge is decreased by a cause other than the exposure, there is the possibility that the toner adheres to a white background in the form of very small black points to cause fogging of the image, so-called black flickers, and the image quality is considerably deteriorated.

In the photoconductor 2 of the second embodiment of the present invention, the injection of the electric charge into the photosensitive layer 14 from the conductive support 11 can be prevented since the intermediate layer 18 is provided between the conductive support 11 and the photosensitive layer 14 as described above. Therefore, a decrease in the chargeability of the photosensitive layer 14 can be prevented, a decrease in the surface charge in a portion other than portions to be exposed can be suppressed, and thus the occurrence of the defects such as fogging of the image can be prevented.

Also, since the defects on the surface of the conductive support 11 are covered by providing the intermediate layer 18 and the uniform surface can be obtained, the film formability of the photosensitive layer 14 can be increased.

Further, since the intermediate layer 18 works as an adhesive for the conductive support 11 to adhere to the photosensitive layer 14, separation of the photosensitive layer 14 from the conductive support 11 can be prevented.

When the intermediate layer 18 is provided between the conductive support 11 and the photosensitive layer 14 as above, there is the possibility of a decrease in the sensitivity of the photoconductor. However, since the photosensitive layer 14 in the photoconductor 2 contains the charge transporting substance of the present invention having the excellent charge transporting capability, a decrease in the sensitivity caused by providing the intermediate layer 18 does not occur in the photoconductor 2. That is, the photoconductor 2 of the present invention can provide the intermediate layer 18 without decreasing the sensitivity.

Examples of the intermediate layer 18 to be used are a resin layer comprising various kinds of resin materials, an alumite layer, or the like.

Examples of the resin materials forming the resin layer may be synthetic resins such as polyethylene resin, polypropylene resin, polystyrene resin, acrylic resin, vinyl chloride resin, vinyl acetate resin, polyurethane resin, epoxy resin, polyester resin, melamine resin, silicone resin, polyvinyl butyral resin, and polyamide resin, and copolymer resins containing two or more repeating units composing these synthetic resins. Also, casein, gelatin, polyvinyl alcohol, and ethyl cellulose are included.

Use of polyamide resin among these resins is preferable and particularly, an alcohol-soluble nylon resin is preferably used. Preferable examples of the alcohol-soluble nylon resin are so-called copolymer nylon obtained by copolymerization of nylon such as 6-nylon, 6,6-nylon, 6,10-nylon, 11-nylon, and 12-nylon and resins obtained by chemically modifying nylon such as N-alkoxymethyl-modified nylon and N-alkoxyethyl-modified nylon.

The intermediate layer 18 may contain particles such as metal oxide particles. Addition of the particles to the intermediate layer 18 makes it possible to adjust the volume resistance of the layer and to efficiently prevent injection of the electric charge into the photosensitive layer 14 from the conductive support 11. Also, the electric properties of the photoconductor 2 can be maintained in various environmental conditions and the environmental stability can be improved.

Examples to be contained as the metal oxide particles may be particles of titanium oxide, aluminum oxide, aluminum hydroxide, and tin oxide.

The intermediate layer 18 can be formed, for example, by applying the coating solution to the surface of the conductive support 11, the coating solution for the intermediate layer prepared by dissolving or dispersing the above resin in a proper solvent. In the case of adding particles such as the metal oxide particles to the intermediate layer 18, the intermediate layer 18 can be formed by applying the coating solution to the surface of the conductive support 11, the coating solution for the intermediate layer prepared by dispersing the particles in the resin solution obtained by dissolving the above resin in a proper solvent.

The solvent to be used for the coating solution for the intermediate layer may be water, various kinds of organic solvents, or a mixture of them. Among these solvents, a single solvent such as water, methanol, ethanol or butanol, or a mixed solvent such as a mixture of water and alcohol; two or more alcohols; alcohols with acetone or dioxolane; or alcohols with chlorine-based solvents such as dichloroethane, chloroform or trichloroethane is preferably used.

A method for dispersing the above metal oxide particle in the resin solution may be a well-known method using a ball mill, a sand mill, an attriter, a vibration mill, a ultrasonic dispersing apparatus, a paint shaker or the like.

In the coating solution for the intermediate layer, the weight ratio (C/D) of the total weight (C) of the resin and metal oxide to the weight (D) of the solvent used for the coating solution for the intermediate layer is preferable in a range from 1/99 to 40/60, and more preferable in a range from 2/98 to 30/70.

The weight ratio E/F of the weight E of the resin and the weight F of the metal oxide is preferable in a range from 90/10 to 1/99, and more preferable in a range from 70/30 to 5/95.

A coating method for the coating solution for the intermediate layer may include a spray method, a bar coating method, a roll coating method, a blade method, a ring coating method, and an immersion coating method. Especially, the immersion coating method among the coating methods is preferably employed, also for the formation of the intermediate layer, since the method is relatively simple and excellent in the productivity and the cost.

The thickness of the intermediate layer 18 is preferable in a range from 0.01 μm or thicker to 20 μm or thinner, and more preferable in a range from 0.05 μm or thicker to 10 μm or thinner. If the thickness of the intermediate layer 18 is thinner than 0.01 μm, the intermediate layer 18 does not practically function well and is insufficient to give uniform surface property of covering the defects of the conductive support 11, and there is the possibility that injection of the electric charge into the photosensitive layer 14 from the conductive support 11 cannot be prevented and a decrease in the chargeability of the photosensitive layer 14 may occur.

If the thickness of the intermediate layer 18 exceeds 20 μm, in the case of forming the intermediate layer by the immersion coating method, it is not preferable since it is difficult to form the intermediate layer and to uniformly form the photosensitive layer 14 on the intermediate layer at the same time, and there is the possibility of a decrease in the sensitivity of the photoconductor 2.

In the same manner as the embodiment 1, a plasticizer, a levering agent, or various kinds of additives such as fine particles of inorganic compounds or organic compounds may be added to the charge transporting layer 16 in this embodiment. Also, in the same manner as the embodiment 1, a sensitizer such as electron acceptor substances and coloring materials, an antioxidant, or an additive such as ultraviolet absorbers may be added to each of the layers 15 and 16 of the photosensitive layer 14.

Embodiment 3

FIG. 3 is a partial cross-sectional view showing a simplified configuration of an electrophotographic photoconductor 3 of a third embodiment of the present invention. With respect to the electrophotographic photoconductor 3 of this embodiment, same symbols are assigned to the parts similar and corresponding to those of the electrophotographic photoconductor 2 of the second embodiment and their explanations will be omitted.

The outstanding point in the electrophotographic photoconductor 3 is that the photosensitive layer 14 has a monolayer structure consist of a single layer containing both of the charge generating substance and the charge transporting substance. That is, the photoconductor 3 is a monolayer-type photoconductor.

The monolayer-type photoconductor 3 of this embodiment is desirable as a photoconductor for a positive charge-type image forming apparatus which generates a small quantity of ozone and is superior than the layered-type photoconductors 1 and 2 of the embodiments 1 and 2 in production cost and the yield of products.

The photosensitive layer 14 can be formed by adhering the charge generating substance to a compound containing the hydrazone structure and the bisbutadiene structure or the bistriene structure represented by the general formula (1) and a charge transporting substance other than the above compounds if necessary by using a binder resin. As the binder resin to be used may be the binder resin for the charge transporting layer 16 exemplified in the embodiment 1.

In the same manner as the photosensitive layer 14 of the embodiment 1, a plasticizer, leveling agent, fine particles of inorganic compounds or organic compounds, a sensitizer such as electron acceptor substances and coloring materials, an antioxidant, or various kinds of additives such as ultraviolet absorbers may be added to the photosensitive layer 14.

The photosensitive layer 14 can be formed by a method similar to the method which forms the charge transporting layer 16 provided to the photoconductor 1 of the embodiment 1. For example, the photosensitive layer 14 can be formed by applying the coating solution to the intermediate layer 18 by the immersion coating method or the like, the coating solution for the photosensitive layer prepared by dissolving or dispersing the charge generating substance, the charge transporting substance represented by the general formula (1), (2) or (3) and a proper quantity of the binder resin, and a charge transporting substance other than the ones of the present invention and a proper quantity of an additive if necessary, in a proper solvent similar to the coating solution for the charge transporting layer of the embodiment 1.

A weight ratio (B'/A') of the weight of the binder resin (B') to the weight of the charge transporting substance (A') represented by the general formula (1), (2) or (3) in the photosensitive layer 14 of this embodiment is desirable in a range from 1.2 or higher to 3.0 or lower, similar to the weight ratio B/A of the weight of the binder resin (B) to the weight of the charge transporting substance (A) in the charge transporting layer 16 of the embodiment 1.

The thickness of the photosensitive layer 14 is preferable in a range from 5 μm or thicker to 100 μm or thinner, and more preferable in a range from 10 μm or thicker to 50 μm or thinner. If the thickness of the photosensitive layer 14 is thinner than 5 μm, there is the possibility of a decrease in the charge retaining capacity of the photoconductor surface. If the thickness of the photosensitive layer 14 exceeds 100 μm, there is the possibility of a decrease in the productivity.

The electrophotographic photoconductor of the present invention is not limited to the configurations of the electrophotographic photoconductors 1, 2 and 3 of the embodiments 1 to 3 illustrated in FIGS. 1 to 3, and it may include other configurations which contain the charge transporting substance of the present invention represented by the general formula (1), (2) or (3) in the photosensitive layer, the charge transporting substance having three stilbene structures or butadiene structures in a molecule.

For example, the electrophotographic photoconductor may have a configuration containing a surface protection layer on each surface of the photosensitive layer 14 of the embodiments 1 to 3. The mechanical durability of the photoconductors 1, 2 and 3 can be improved by providing the surface protection layer on the surface of the photosensitive layer 14. Also, chemical adverse effects on the photosensitive layer 14 caused by active gases such as ozone and nitrogen oxide ($NO_x$) generated by corona discharge at the time of charging the photoconductor surface can be prevented to improve the electrical durability of the photoconductors 1, 2 and 3.

Examples of the surface protection layer to be used may be a layer comprising resin, resin containing inorganic filler, or inorganic oxide.

An image forming apparatus comprising an electrophotographic photoconductor of the present invention will be described. Incidentally, the image forming apparatus of the present invention is not limited only to the following explanations.

Embodiment 4

FIG. 4 is a side face drawing of the configuration illustrated a simplified image formation apparatus 100 of an embodiment of an image forming apparatus of the present invention. The image forming apparatus 100 shown in FIG. 4 comprises the photoconductor 1 shown in FIG. 1 of the first embodiment of the electrophotographic photoconductor of the present invention. Hereinafter, with reference to FIG. 4, the configuration of the image forming apparatus and the image formation operation will be explained.

The image forming apparatus 100 is provided with the photoconductor 1 freely rotatably supported by the apparatus body not illustrated and driving means not illustrated to rotate the photoconductor 1 around a rotational axis 44 in the direction shown as an arrow 41. The driving means is provided, for example, with a motor as a power source to rotate the photoconductor 1 at the predetermined peripheral speed Vp by transmitting the power from the motor to the support composing a core body of the photoconductor 1 through a gear wheel (Hereinafter, referred the circuit speed Vp to as a rotational speed Vp of the photoconductor 1 in some cases).

A charging apparatus 32, an exposing means 30, a developer 33, a transferring apparatus 34, and a cleaner 36 are arranged around the photoconductor 1 in this order from the upstream to the downstream in the rotational direction of the photoconductor 1 shown by the arrow 41. The cleaner 36 is disposed with an electrostatic elimination lamp not illustrated.

The charging apparatus 32 is charging means for charging a surface 43 of the photoconductor 1 at a prescribed potential. The charging apparatus 32 is, for example, contact-type charging means such as a charging roller.

The exposing means 30 is provided, for example, with a semiconductor laser as a light source to form an electrostatic latent image on the surface 43 of the photoconductor 1 by exposing the surface 43 of the photoconductor 1 which is charged by light 31 such as a laser beam generated by the light source corresponding to the image information.

The developer 33 is developing means for developing the electrostatic latent image formed on the surface 43 of the photoconductor 1 by using a developer and for forming a toner image which is a visible image, and is provided with an image roller 33*a* which is disposed toward the photoconductor 1 and provides a toner on the surface 43 of the photoconductor 1, and a casing 33*b* which stores the developer containing the toner in a space inside thereof in addition to rotatably supporting the image roller 33*a* around a rotational axis parallel to the rotational axis 44 of the photoconductor 1.

The transferring apparatus 34 is transferring means for transferring the toner image formed on the surface 43 of the photoconductor 1 from the surface 43 onto recording paper 51 which is a transfer material. The transferring apparatus 34 is provided, for example, with charging means such as a corona discharging apparatus, and noncontact-type transferring means for transferring the toner image onto the recording paper 51 by providing the electric charge with the recording paper 51, which is opposite in polarity to the toner.

The cleaner 36 is cleaning means for cleaning the surface 43 of the photoconductor 1 after the toner image is transferred by the transferring apparatus 34, and is provided with a cleaning blade 36*a* which exfoliates the toner remained on the surface 43, and with a casing 36*b* which recovers and stores the toner exfoliated by the cleaning blade 36*a*.

A fixing apparatus 35 which is fixing means for fixing the transferred toner image is disposed in the direction of the recording paper 51 to be conveyed after the recording paper passes between the photoconductor 1 and the transferring apparatus 34. The fixing apparatus 35 is provided with a heating roller 35*a* having heating means not illustrated, and a pressurizing roller 35*b* which is disposed toward the heating roller 35*a* and forms a contacting portion with the heating roller 35*a* by pressurizing the heating roller 35*a*.

The image formation operation of the image forming apparatus 100 will be explained. The photoconductor 1 is rotated by the driving means in the direction shown as the arrow 41 corresponding to a signal from a controlling section not illustrated, and the surface 43 of the photoconductor 1 is uniformly charged at a prescribed potential of positive or negative by the charging apparatus 32 which is disposed at the upstream side of the rotational direction of the photoconductor 1 from an image formation point of the light 31 generated by the exposing means 30.

Next, the exposing means 30 irradiates the charged surface 43 of the photoconductor 1 with the light 31 corresponding to a signal from the control section. The light 31 from the light source repeatedly scans the surface 43 in the longitudinal direction of the photoconductor 1, which is the main scanning direction, according to the image information. The photoconductor 1 is rotated and the light 31 from the light source repeatedly scans the surface 43 according to the image information in order to carry out exposure corresponding to the image information on the surface 43 of the photoconductor 1. The surface charge of a part irradiated with the light 31 is decreased by the exposure to cause the difference between the surface potential of the part irradiated with the light 31 and a part not irradiated with the light 31 and to form the electrostatic latent image on the surface 43 of the photoconductor 1. Also, the recording paper 51 is provided at a transferring point between the transferring apparatus 34 and the photoconductor 1 from the direction shown as an arrow 42 by conveying means synchronously with the exposure of the photoconductor 1.

Then, the toner is provided on the surface 43 of the photoconductor 1 where the electrostatic latent image is formed, by the image roller 33*a* of the developer 33 at the downstream side of the rotational direction of the photoconductor 1 from the image formation point of the light 31 from the light source. By doing so, the electrostatic latent image is developed and the toner image which is the visible image is formed on the surface 43 of the photoconductor 1. When the recording paper 51 is provided between the photoconductor 1 and the transferring apparatus 34, the electric charge which is opposite in polarity to the toner is supplied to the recording paper 51 by the transferring apparatus 34 in order to transfer the toner image formed on the surface 43 of the photoconductor 1 onto the recording paper 51.

The recording paper 51 onto which the toner image is transferred is conveyed to the fixing apparatus 35 by the conveying means and is heated and pressurized when passing the contact portion of the heating roller 35*a* and the pressurizing roller 35*b* of the fixing apparatus 35. By doing so, the toner image on the recording paper 51 is strongly fixed on the recording paper 51. The recording paper 51 on which the image is formed in the above-mentioned manner is discharged outside of the image forming apparatus 100 by the conveying means.

On the other hand, after the toner image is transferred onto the recording paper 51, the photoconductor 1 is kept on rotating in the direction shown as the arrow 41 and the surface 43 of the photoconductor 1 is abraded and cleaned by the cleaning blade 36*a* installed in the cleaner 36. The surface 43 of the photoconductor 1 from which the toner is removed in the above-mentioned manner removes the electric charge by light from the static elimination lamp, thereby eliminating the electrostatic latent image on the surface 43 of the photoconductor 1. After that, the photoconductor 1 is further kept on rotating and the series of the steps starting from the charging of the photoconductor 1 are repeated again. By doing so, the image is continuously formed.

The photoconductor 1 installed in the image forming apparatus 100 contains, as described above, the compound having the hydrazone structure and the bisbutadiene structure or the bistriene structure represented by the general formula (1), as the charge transporting substance in the photosensitive layer 14, and is excellent in the electrical properties such as the chargeability, the sensitivity and the photo-response, the electrical and the mechanical durabilities, and the environmental stability. Therefore, the image forming apparatus 100 which is stable for a long duration in various environmental conditions and has the high reliability to form the high-quality image can be produced. Also, since the electrical properties of the photoconductor 1 are not deteriorated even if the photoconductor 1 is exposed to light, image quality deterioration attributed to exposure of the photoconductor 1 to light can be suppressed at the time of maintenance.

Further, since the photoconductor 1 does not cause a decrease in the image quality even if used for the electrophotographic process, image forming speed of the image forming apparatus 100 can be accelerated. For example, if the photoconductor 1 having a diameter of 30 mm and a longitudinal length of 340 mm is used to carry out the high-speed electrophotographic process wherein the circuit speed Vp on the order of 100 to 140 mm per second is set, and the image forming speed of the image forming apparatus 100 is set at a speed on the order of 25 A4-size sheets per minute provided by JIS P0138 to form the image, the high-quality image can be provided.

The image forming apparatus of the present invention is not limited to the configuration of the image forming apparatus 100 illustrated in FIG. 4, and it may include other configurations which can employ the photoconductor set forth in the present invention.

For example, although the charging apparatus 32 in the image forming apparatus 100 of this embodiment is the contact-type charging means, it is not limited to that and may be noncontact-type charging means such as a corona discharging apparatus. Also, though the transferring apparatus 34 is the noncontact-type transferring means for transferring the image without using pressure power, it is not limited to that and may be contact-type transferring means for transferring the image by using the pressure power. Examples of the contact-type transferring means are ones having a transferring roller to pressurize the transferring roller against the photoconductor 1 from the opposite side of the contact side of the recording paper 51 which is in contact with the surface 43 of the photoconductor 1 and to transfer the toner image onto the recording paper 51 by impressing the voltage to the transferring roller in the state of the photoconductor 1 and the recording paper 51 pressurized.

Examples

Hereinafter, the present invention will be described more in detail with reference to Production Examples, Examples and Comparative Examples. However, it is not intended that the present invention is limited only to those examples.

Production Example 1

Production of Example Compound No. 4

At first, a Vilsmeier reagent was prepared by gradually adding 5.52 g (1.2 mol equivalent) of oxyphosphorus chloride to 100 mL of anhydride N,N-dimethylformamide (DMF) under ice-cooling, and stirring the solution for approximately 30 minutes. To this solution, 18.96 g (1.0 mol equivalent) of an enamine compound which synthesized according to a method described in Japanese Patent Application Laid-Open No. 2000-112157, and represented by the formula (7):

(7)

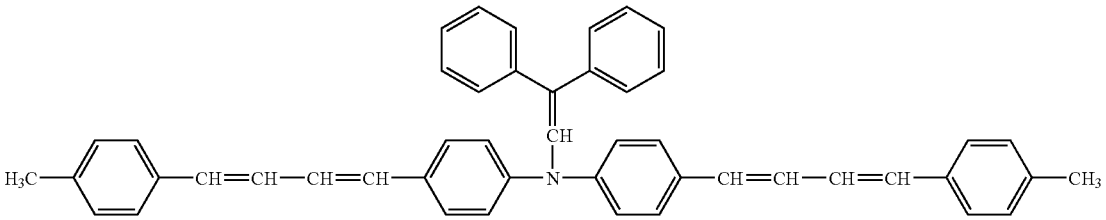

was added in small portions under ice-cooling. Next, the solution was gradually heated up to 80° C. to cause the reaction with stirring for 6 hours, while the temperature was maintained between 80° C. and 90° C. After the reaction, the reaction solution was stood to cool, and was added in small portions to 800 mL of a cold 4 normal (4N) sodium hydroxide aqueous solution to cause the precipitate. The obtained precipitate was filtrated and wished with water thoroughly, and was recrystallized from a mixed solution of ethanol and ethyl acetic acid to give 16.0 g of a yellow-powdered compound.

A peak which corresponding to a value of molecular ions $[M+H]^+$ wherein protons are added to an aldehyde compound (calculated molecular weight: 631.32) which is a purpose compound and represented by the formula (8):

(8)

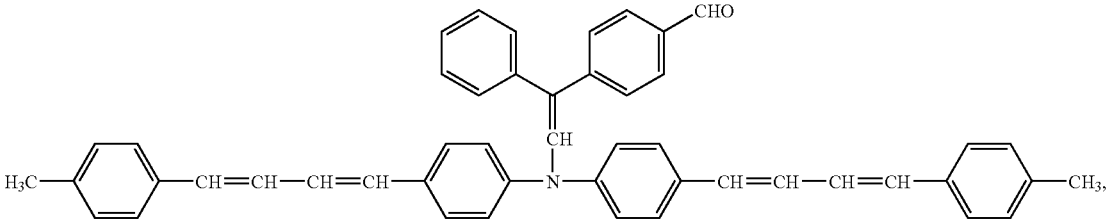

was observed at 632.8 by analyzing the obtained crystals by the Liquid Chromatography-Mass Spectrometry (LC-MS). As a result, the obtained compound was confirmed to be an aldehyde compound having a structure represented by the above formula (8) (the yield: 81%). Also, as the result of analyzing the obtained aldehyde compound by the LC-MS, purity of the compound was found to be 99.0%.

Next, 6.59 g (1.0 mol equivalent) of the obtained aldehyde compound and 3.36 g (1.2 mol equivalent) of a Wittig reagent represented by the formula (9):

(9)

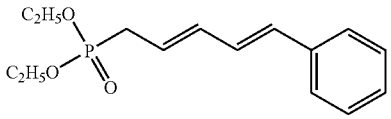

were added to 80 mL of anhydride DMF and dissolved, and then 1.40 g (1.25 mol equivalent) of potassium t-butoxide was added in small portions to the solution while cooling it at 0° C.

After that, the reaction solution was stirred for 1 hour at room temperature and then it was heated up to 40° C. to cause the reaction with stirring for 7 hours while maintaining at 40° C. After the reaction solution was stood to cool, it was poured into excess amount of methanol. The precipitate was obtained after filtration, and was dissolved in toluene. The toluene solution was transferred into a separator funnel and washed with water, and then the organic layer was separated and dried over magnesium sulfate. After drying, the organic solution was filtrated and evaporated, and the obtained residue was purified by the silica gel column chromatography to give 6.69 g of yellow crystals.

As a result of analyzing the obtained crystals by the LC-MS, a peak which corresponding to a value of molecular ions $[M+H]^+$ wherein protons are added to a tris-butadiene compound (calculated molecular weight: 759.39) which is a purpose compound as Example Compound No. 4 shown in Table 1 was observed at 760.8. Consequently, the obtained crystals were confirmed to be tris-butadiene of Example Compound No. 4 (the yield: 88%).

Also, as a result of analyzing the obtained Example Compound No. 4 by the LC-MS, purity of the compound was found to be 99.0%. Additionally, the elemental analysis of the obtained Example Compound No. 4 was carried out by using the coincidence assay of carbon (C), hydrogen (H) and nitrogen (N) according to the differential heat conductivity method. Production Examples below were analyzed in the same manner as Production Example 1.

The elemental analysis of Example Compound No. 4:
Theoretical values; C: 91.66%; H: 6.50%; N: 1.84%
Found; C: 91.58%; H: 6.52%; N: 1.90%

Production Example 2

Production of Example Compound No. 15

In the same manner as the case of the Production Example 1, a compound of Example Compound 15 was obtained by using an enamine compound as a raw material represented by the formula (10):

(10)

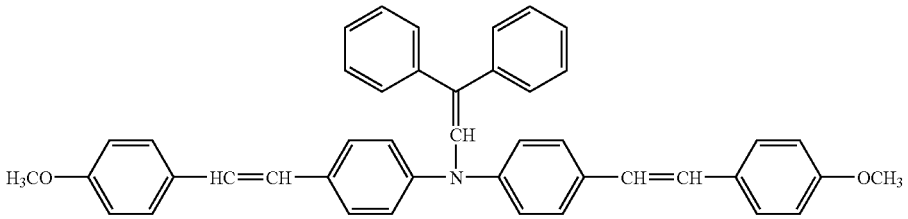

which was synthesized according to the method described in Japanese Patent Application Laid-Open No. 2000-112157 or Japanese Patent No. 3580426, and using the Wittig reagent corresponding to Example Compound 15.

As results of analyzing the obtained compound by the LC-MS and the elemental analysis, the obtained compound was confirmed to be a compound of Example Compound No. 15 and the results are as follows.

Example Compound No. 15

LC-MS $[M+H]^+$: Obtained: 744.9
(calculated molecular weight: 743.34)
Purity: 99.2%

<Elemental Analysis>:
Theoretical values; C: 85.57%; H: 6.10%; N: 1.88%
Found; C: 85.48%; H: 6.08%; N: 1.90%

Production Example 3

Production of Example Compound No. 33

In quite the same manner as the case of the Producing Example 1, a compound of Example Compound 33 was obtained by using an enamine compound as a raw material represented by the formula (11):

which was synthesized according to the method described in Japanese Patent Application Laid-Open No. 2000-112157 or Japanese Patent No. 3580426.

As results of analyzing the obtained compound by the LC-MS and the elemental analysis, the obtained compound was confirmed to be a compound of Example Compound No. 33 and the results are as follows.

Example Compound No. 33

LC-MS $[M+H]^+$: Obtained: 790.9
(calculated molecular weight: 789.36)
Purity: 99.0%

<Elemental Analysis>:
Theoretical values; C: 88.18%; H: 6.00%; N: 1.77%
Found: C: 88.08%; H: 6.08%; N: 1.80%

Production Examples 4 to 52

Production of Example Compounds No. 1 to 3, 5 to 14, 16 to 32 and 34 to 52

In quite the same manner as the cases of the above Production Examples 1 to 3, objective Example compounds were respectively obtained from the corresponding starting materials.

The Example Compounds obtained from each Production Example above and represented by the formula (1) are shown in Table 1.

(11)

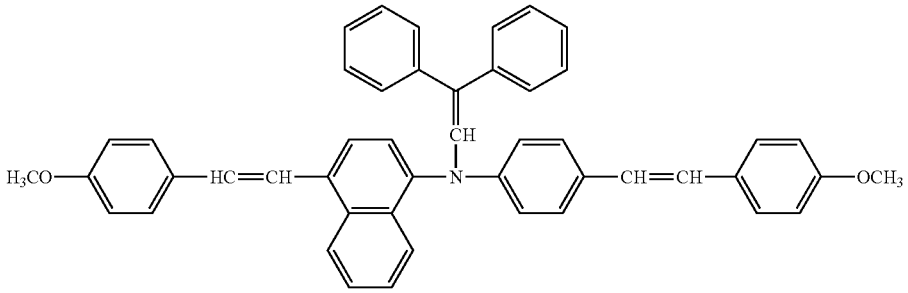

TABLE 1
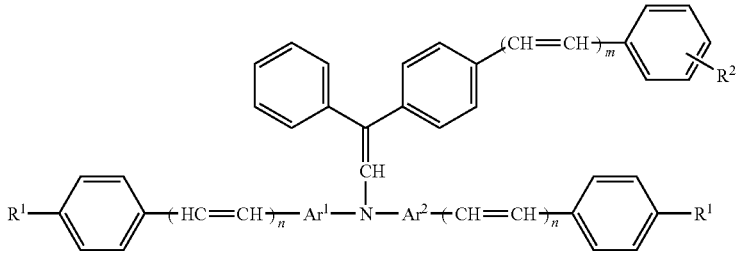
| Example compound | N—Ar¹ | N—Ar² | R¹ | R² | n | m |
|---|---|---|---|---|---|---|
| 1 | 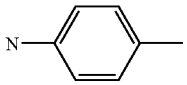 | 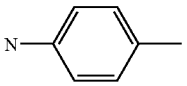 | —$CH_3$ | H | 1 | 1 |
| 2 | 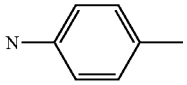 | 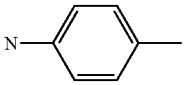 | —$CH_3$ | H | 2 | 1 |
| 3 | 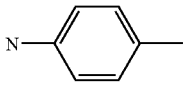 | 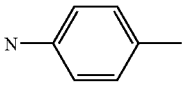 | —$CH_3$ | H | 1 | 2 |
| 4 | 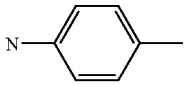 | 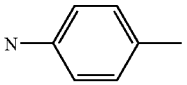 | —$CH_3$ | H | 2 | 2 |
| 5 | 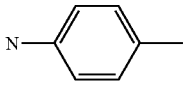 | 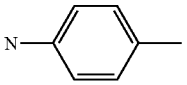 | —$CH_3$ | —$CH_3$ | 1 | 2 |
| 6 | 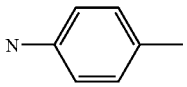 | 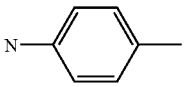 | —$CH_3$ | —$OCH_3$ | 1 | 2 |
| 7 | 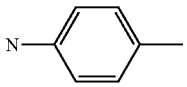 | 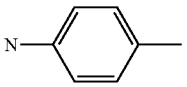 | —$CH_3$ | —$CH_3$ | 2 | 2 |
| 8 | 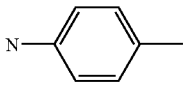 | 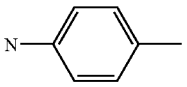 | —$CH_3$ | —$OCH_3$ | 2 | 2 |
| 9 | 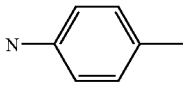 | 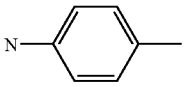 | —$C_2H_5$ | H | 1 | 2 |
| 10 | 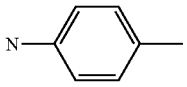 | 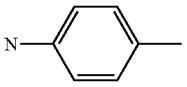 | —CF3 | H | 1 | 2 |
| 11 | 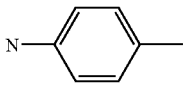 | 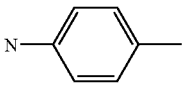 | —$OCH_3$ | H | 1 | 1 |
| 12 | 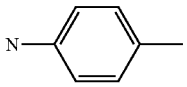 | 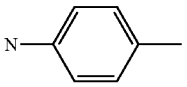 | —$OCH_3$ | H | 1 | 2 |

TABLE 1-continued
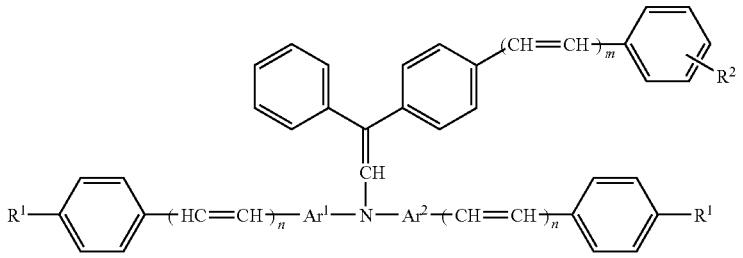
| Example compound | N—Ar[1] | N—Ar[2] | R[1] | R[2] | n | m |
|---|---|---|---|---|---|---|
| 13 | 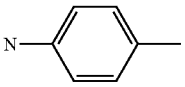 | 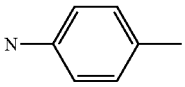 | —$OCH_3$ | H | 2 | 1 |
| 14 | 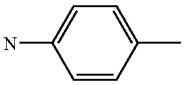 | 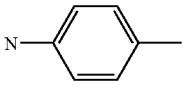 | —$OCH_3$ | H | 2 | 2 |
| 15 | 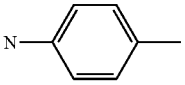 | 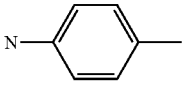 | —$OCH_3$ | —$OCH_3$ | 1 | 1 |
| 16 | 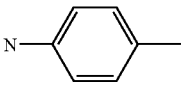 | 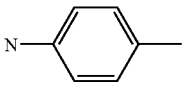 | —$OCH_3$ | —$CH_3$ | 1 | 2 |
| 17 | 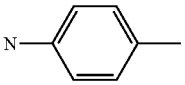 | 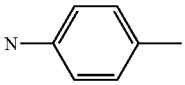 | —$OCH_3$ | —$OCH_3$ | 1 | 2 |
| 18 | 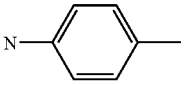 | 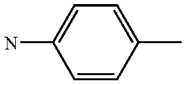 | —$OCH_3$ | —$CH_3$ | 2 | 2 |
| 19 | 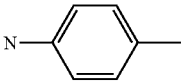 | 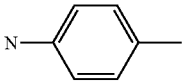 | —$OCH_3$ | —$OCH_3$ | 2 | 2 |
| 20 | 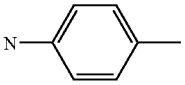 | 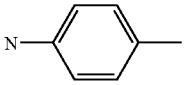 | —$OCH_3$ | —$CH(CH3)_2$ | 1 | 2 |
| 21 | 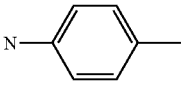 | 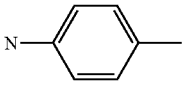 | —$OCH_3$ | —$CH_2CF_3$ | 1 | 2 |
| 22 | 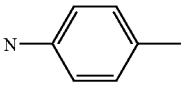 | 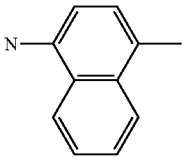 | —$CH_3$ | H | 1 | 1 |
| 23 | 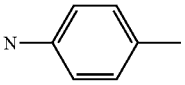 | 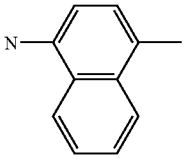 | —$CH_3$ | H | 2 | 1 |

TABLE 1-continued
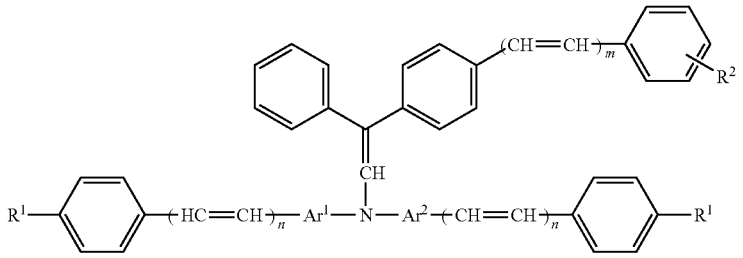
| Example compound | N—Ar¹ | N—Ar² | R¹ | R² | n | m |
|---|---|---|---|---|---|---|
| 24 | 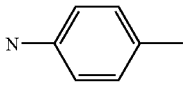 | 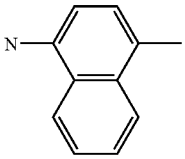 | —$CH_3$ | H | 1 | 2 |
| 25 | 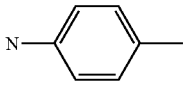 | 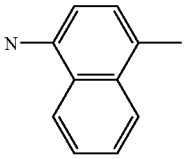 | —$CH_3$ | H | 2 | 2 |
| 26 | 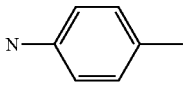 | 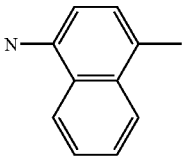 | —$CH_3$ | —$CH_3$ | 1 | 2 |
| 27 | 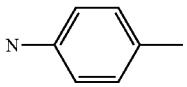 | 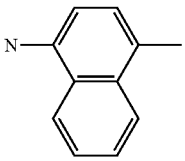 | —$CH_3$ | —$OCH_3$ | 1 | 2 |
| 28 | 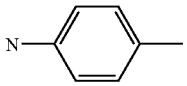 | 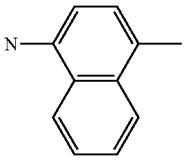 | —$CH_3$ | —$CH_3$ | 2 | 2 |
| 29 | 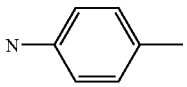 | 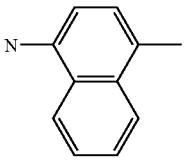 | —$CH_3$ | —$OCH_3$ | 2 | 2 |
| 30 | 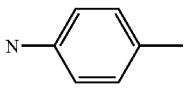 | 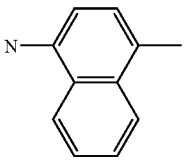 | —$C_2H_5$ | H | 1 | 2 |

TABLE 1-continued
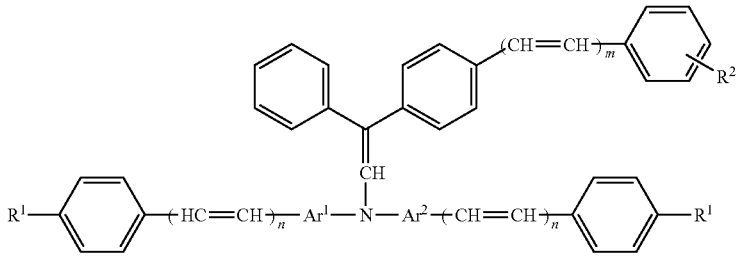
| Example compound | N—Ar[1] | N—Ar[2] | R[1] | R[2] | n | m |
|---|---|---|---|---|---|---|
| 31 | 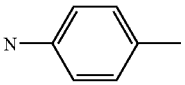 | 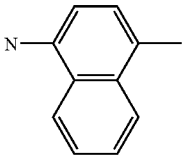 | —CF3 | H | 1 | 2 |
| 32 | 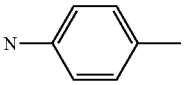 | 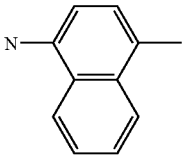 | —$OCH_3$ | H | 1 | 1 |
| 33 | 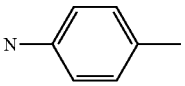 | 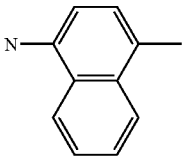 | —$OCH_3$ | H | 1 | 2 |
| 34 | 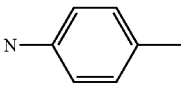 | 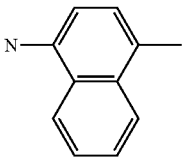 | —$OCH_3$ | H | 2 | 1 |
| 35 | 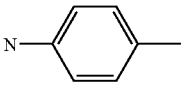 | 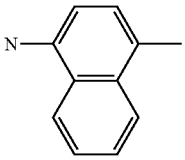 | —$OCH_3$ | H | 2 | 2 |
| 36 | 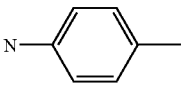 | 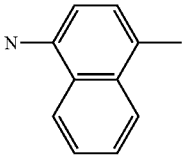 | —$OCH_3$ | —$OCH_3$ | 1 | 1 |
| 37 | 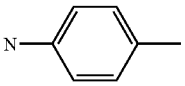 | 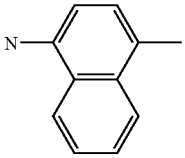 | —$OCH_3$ | —$CH_3$ | 1 | 2 |

TABLE 1-continued
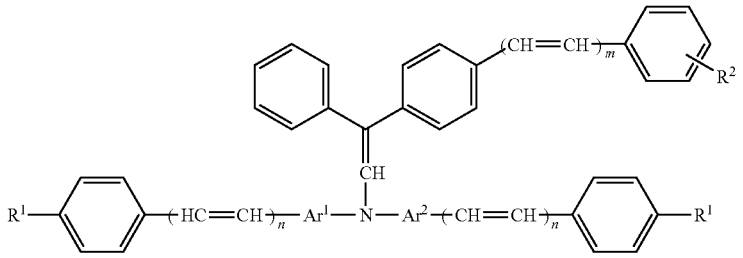
| Example compound | N—Ar[1] | N—Ar[2] | R[1] | R[2] | n | m |
|---|---|---|---|---|---|---|
| 38 | 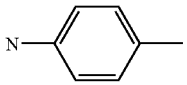 | 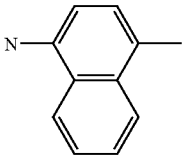 | —$OCH_3$ | —$OCH_3$ | 1 | 2 |
| 39 | 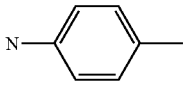 | 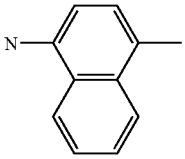 | —$OCH_3$ | —$CH_3$ | 2 | 2 |
| 40 | 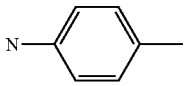 | 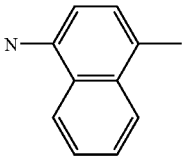 | —$OCH_3$ | —$OCH_3$ | 2 | 2 |
| 41 | 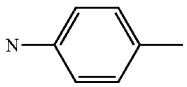 | 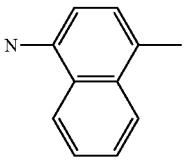 | —$OCH_3$ | —$C_2H_5$ | 1 | 2 |
| 42 | 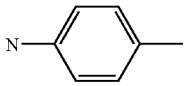 | 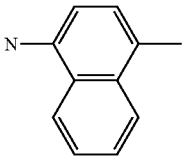 | —$OCH_3$ | —$CH_2CFH_2$ | 1 | 2 |
| 43 | 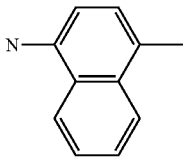 | 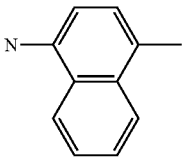 | —$CH_3$ | H | 2 | 1 |
| 44 | 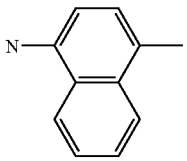 | 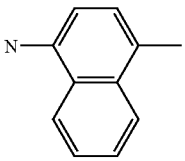 | —$OCH_3$ | H | 1 | 2 |

TABLE 1-continued

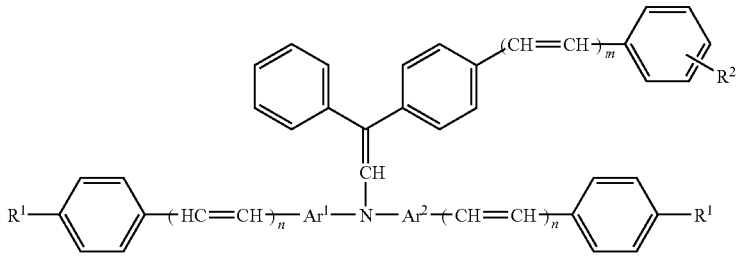

| Example compound | N—Ar¹ | N—Ar² | R¹ | R² | n | m |
|---|---|---|---|---|---|---|
| 45 | 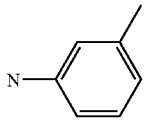 | 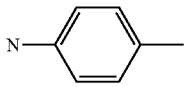 | —$CH_3$ | H | 2 | 1 |
| 46 | 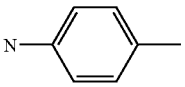 | 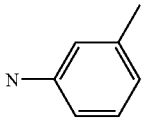 | —$OCH_3$ | H | 1 | 2 |
| 47 | 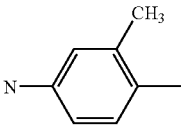 | 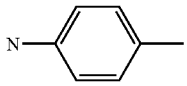 | —$CH_3$ | H | 2 | 1 |
| 48 | 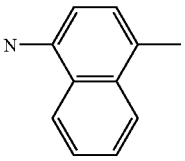 | 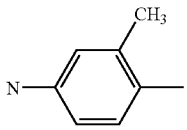 | —$OCH_3$ | H | 1 | 2 |
| 49 | 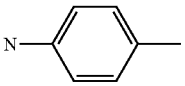 | 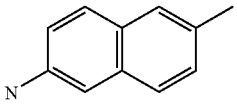 | —$CH_3$ | H | 2 | 1 |
| 50 | 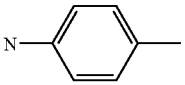 | 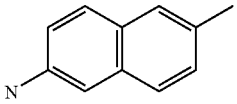 | —$OCH_3$ | H | 1 | 2 |
| 51 | 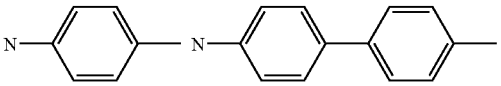 | | —$CH_3$ | H | 2 | 1 |
| 52 | 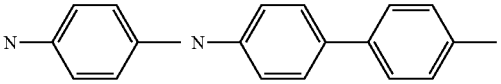 | | —$OCH_3$ | H | 1 | 2 |

Example 1

At first, a coating solution for an intermediate layer was prepared by adding 9 part by weight of arborescent titanium oxide (TTO-D-1 manufactured by Ishihara Sangyo Kabushiki Kaisha, Ltd.) subjected to surface treatment with aluminum oxide ($Al_2O_3$) and zirconium dioxide ($ZrO_2$) and 9 part by weight of copolymer nylon resin (CM8000 manufactured by Toray Kabushiki Kaisha, Inc.) to a mixed solution of 41 part by weight of 1,3-dioxolane and 41 part by weight of methanol, and the obtained mixture was dispersed for 12 hours by a paint shaker. The prepared coating solution for the intermediate layer was applied to a board-like conductive support made of aluminum in 0.2 mm thickness by a baker applicator, and dried to form an intermediate layer in 1 μm thickness.

Next, a coating solution for a charge generating layer was prepared by adding 2 part by weight of X-type nonmetallic phthalocyanine as the charge generating substance to a resin solution which was obtained by dissolving 1 part by weight of polyvinyl butyral resin (BX-1 manufactured by Sekisui Chemical Industries Co., Ltd.) in 97 part by weight of THF, and the obtained mixture was dispersed for 10 hours by the paint shaker. The coating solution for the charge generating layer was applied to the previously formed intermediate layer by the baker applicator, and dried to form a charge generating layer in 0.3 μm thickness.

Next, a coating solution for a charge transporting layer was prepared by dissolving 10 part by weight of the tris-ene compound of Example Compound No. 4 which is shown in Table 1 as the charge transporting substance, 14 part by weight of polycarbonate resin (Z-200 manufactured by Mitsubishi Gas Chemical Company, Inc.) as the binder resin, and 0.2 part by weight of 2,6-di-t-butyl-4-methylphenol in 80 part by weight of THF. The coating solution for the charge transporting layer was applied to the previously formed charge generating layer by the baker applicator, and dried to form a charge transporting layer in 18 μm thickness.

An electrophotographic photoconductor of Example 1 having a layered-type structure shown in FIG. 2 was produced as described above.

Examples 2 and 3

Electrophotographic photoconductors of Examples 2 and 3 were produced in the same manner as Example 1, except that Example Compound No. 15 or No. 33 shown in Table 1 was used as the charge transporting substance instead of Example Compound No. 4.

Comparative Example 1

An electrophotographic photoconductor of Comparative Example 1 was produced in the same manner as Example 1, except that Comparative Compound A represented by the following structural formula (12):

(12)

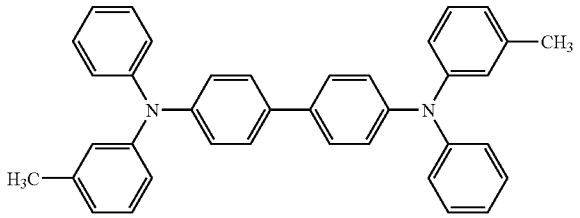

was used as the charge transporting substance instead of Example Compound No. 4.

Example 4

An intermediate layer in 1 μm thickness was formed on a board-like conductive support made of aluminum in 0.2 mm thickness in the same manner as Example 1.

Next, a coating solution for a photosensitive layer was prepared by dispersing 1 part by weight of X-type nonmetallic phthalocyanine as the charge generating substance, 12 part by weight of polycarbonate resin (Z-400 manufactured by Mitsubishi Gas Chemical Company, Inc.) as the binder resin, 10 part by weight of the compound of Example Compound No. 4 shown in Table 1 as the charge transporting substance, 5 part by weight of 3,5-dimethyl-3',5'-di-t-butyldiphenoquinone, 0.5 part by weight of 2,6-di-t-butyl-4-methylphenol, and 65 part by weight of THF for 12 hours by a ball mill. The coating solution for the photosensitive layer was applied to the previously formed intermediate layer by the baker applicator, and dried by hot air at 110° C. for 1 hour to form a photosensitive layer in 20 μm thickness.

An electrophotographic photoconductor of Example 4 having a monolayer-type structure shown in FIG. 3 was produced as described above.

Evaluation 1

Properties at an initial stage and properties after repeatedly used of each photoconductor of Examples 1 to 4 and Comparative Example 1, which was produced as described above were evaluated by using an electrostatic paper analyzer (EPA-8200 manufactured by Kawaguchi Electric Works Co., Ltd.). The evaluation was carried out in an environment of normal temperature/normal humidity (N/N) of 22° C. and at 65% relative humidity (65% RH) and in an environment of low temperature/low humidity (L/L) of 5° C. and at 20% relative humidity (20% RH).

The properties at the initial stage were evaluated as below. The photoconductor surface was charged by impressing 5 kV of the negative voltage to the photoconductor, and the surface potential of the photoconductor at the time was measured as the charging potential $V_0$ [V], then as the absolute value of the charging potential $V_0$ was higher, the chargeability was evaluated as better. However, in the case of the monolayer-type photoconductor of Example 4, the photoconductor surface was charged by impressing 5 kV of the positive voltage.

Next, the charged photoconductor surface was exposed to light. Exposure energy used for reducing the surface potential of the photoconductor by half from the charging potential $V_0$ was measured as a 50% reduction in the amount of light exposure $E_{1/2}$ [μJ/cm$^2$], and as the 50% reduction in the amount of the light exposure $E_{1/2}$ was lower, the sensitivity was evaluated as better. Also, the surface potential of the photoconductor at a point after 10 seconds from starting the exposure was measured as residual potential $V_r$ [V], and as the absolute value of the residual potential $V_r$ was lower, the photo-response was evaluated as better.

Also, monochrome light having 780 nm of a wavelength and 1 μW/cm$^2$ of the exposure energy obtained from spectra by a monochromater was used as the exposure light.

The properties after repeatedly used were evaluated as below. A set of one charging operation and one exposing operation was considered as 1 cycle, and after 5000 cycles were repeated, the charging potential $V_0$, the 50% reduction in the amount of the light exposure $E_{1/2}$, and the residual potential $V_r$ were measured in the same manner as the evaluation of the properties at the initial stage, then the chargeability, the sensitivity, and the photo-response were evaluated.

The above evaluation results are shown in Table 2.

| | Charge | N/N; 22° C./65% | | | | | | L/L; 5° C./20% | | | | | |
|---|---|---|---|---|---|---|---|---|---|---|---|---|---|
| | | Initial properties | | | Repeatedly using properties | | | Initial properties | | | Repeatedly using properties | | |
| | Transporting material | $E_{1/2}$ (mJ/cm$^2$) | $V_0$ (V) | $V_r$ (V) | $E_{1/2}$ (mJ/cm$^2$) | $V_0$ (V) | $V_r$ (V) | $E_{1/2}$ (mJ/cm$^2$) | $V_0$ (V) | $V_r$ (V) | $E_{1/2}$ (mJ/cm$^2$) | $V_0$ (V) | $V_r$ (V) |
| Ex 1 | Ex Compd 4 | 0.17 | −572 | −22 | 0.20 | −564 | −42 | 0.20 | −573 | −38 | 0.23 | −566 | −49 |
| Ex 2 | Ex Compd 15 | 0.19 | −569 | −23 | 0.22 | −561 | −40 | 0.21 | −574 | −35 | 0.24 | −568 | −47 |
| Ex 3 | Ex Compd 33 | 0.20 | −580 | −21 | 0.22 | −574 | −44 | 0.23 | −582 | −32 | 0.26 | −576 | −46 |
| Comp Ex 1 | Comp Compd A | 0.24 | −578 | −35 | 0.25 | −576 | −48 | 0.36 | −580 | −45 | 0.40 | −578 | −58 |
| Ex 4 | Ex Compd 4 | 0.20 | 545 | 24 | 0.22 | 537 | 40 | 0.23 | 548 | 33 | 0.26 | −537 | 55 |

As shown in Table 2, the photoconductors of Examples 1 to 4 which use the tris-ene compound as the charge transporting substance represented by the general formula (1) are found to excel in the chargeability, the sensitivity, and the photo-response in both the N/N environment and the L/L environment. Also, the photoconductors of Examples 1 to 4 are found to have the excellent electrical properties as good as the photoconductors at the initial stage even after repeatedly used.

Example 5

At first, a coating solution for an intermediate layer was prepared by adding 9 part by weight of arborescent titanium oxide (TTO-D-1 manufactured by Ishihara Sangyo Kabushiki Kaisha, Ltd.) subjected to surface treatment with aluminum oxide ($Al_2O_3$) and zirconium dioxide ($ZrO_2$) and 9 part by weight of a copolymer nylon resin (CM8000 manufactured by Toray Kabushiki Kaisha, Inc.) to a mixed solution of 41 part by weight of 1,3-dioxolane and 41 part by weight of methanol, and the obtained mixture was dispersed for 8 hours by the paint shaker. A coating bath was filled with the coating solution for the intermediate layer, and a cylindrical conductive support made of aluminum having a diameter of 40 mm and a longitudinal length of 340 mm was immersed in the coating bath, pulled up, and dried to form an intermediate layer in 1.0 μm thickness on the conductive support.

Next, a coating solution for a charge generating layer was prepared by mixing 2 part by weight of oxotitanium phthalocyanine having a crystalline structure indicating a diffraction peak of at least the Bragg angle 2θ at 27.2° in an X-ray diffraction spectrum with respect to the Cu—Kα characteristic X-ray (wavelengths: 1.54 Å), 1 part by weight of polyvinyl butyral resin (S-LEC BM-S manufactured by Sekisui Chemical Industries Co., Ltd.), and 97 part by weight of methylethylketon, as charge generating substances, and the obtained mixture was dispersed by the paint shaker. The coating solution for the charge generating layer was applied to the intermediate layer by the immerse coating method in the same manner as the previously formed intermediate layer, and dried to form a charge generating layer in 0.4 μm thickness.

Next, a coating solution for a charge transporting layer was prepared by dissolving 10 part by weight of the compound of Example Compound No. 4 shown in Table 1 as the charge transporting substance, 20 part by weight of a polycarbonate resin (Iupilon Z200 manufactured by Mitsubishi Engineering-Plastics Corp.) as a binder resin, 1 part by weight of 2,6-di-t-butyl-4-methylphenol, and 0.004 part by weight of dimethyl polysiloxane (KF-96 manufactured by Shin-Etsu Chemical Co., Ltd.) in 110 part by weight of tetrahydrofuran (THF). The coating solution for the charge transporting layer was applied to the previously formed charge generating layer by the immerse coating method in the same manner as the previously formed intermediate layer, and dried at 110° C. for 1 hour to form a charge transporting layer in 23 μm thickness.

An electrophotographic photoconductor of Example 5 was produced as described above.

Examples 6 and 7

Electrophotographic photoconductors of Examples 6 and 7 were produced in the same manner as Example 5, except that Example Compound No. 15 or No. 33 shown in Table 1 as the charge transporting substance was used instead of Example Compound No. 4.

Comparative Example 2

An electrophotographic photoconductor of Comparative Example 2 was produced in the same manner as Example 5, except that Comparative Compound A represented by the above structural formula (12) as the charge transporting substance was used instead of Example Compound No. 4.

Example 8

An electrophotographic photoconductor of Example 8 was produced in the same manner as Example 5, except that the amount of the polycarbonate resin as the binder resin was changed to 25 part by weight when forming the charge transporting layer.

Examples 9 and 10

Electrophotographic photoconductors of Examples 9 and 10 were produced in the same manner as Example 5, except that the amount of the polycarbonate resin as the binder resin was changed to 25 part by weight when forming the charge transporting layer and that Example Compound No. 15 or No. 33 shown in Table 1 as the charge transporting substance was used instead of Example Compound No. 4.

Example 11

Reference Example 1

An electrophotographic photoconductor of Example 11 was produced in the same manner as Example 5, except that the amount of the polycarbonate resin as the binder resin was changed to 10 part by weight when forming the charge transporting layer.

Reference Example 2

An electrophotographic photoconductor of Example 11 was produced in the same manner as Example 5, except that the amount of the polycarbonate resin as the binder resin was changed to 31 part by weight when forming the charge transporting layer. However, since the polycarbonate resin was not completely dissolved in the same amount of THF as Example 5 and the viscosity of the coating solution for the charge transporting layer increased, THF was added to the solution to prepare the solution in which the polycarbonate resin was completely dissolved in order to form a charge transporting layer.

However, since the cloudiness at a tip of the longitudinal direction of the cylindrical photoconductor was caused by the brushing phenomenon, property evaluations indicated in Evaluation 2 below were not carried out. It is deemed that the brushing phenomenon occurred by the excess amount of a solvent in the coating solution for the charge transporting layer.

Evaluation 2

Each photoconductor of Examples 5 to 7 and Comparative Example 2 as produced above was measured for the Hale mobility at electrolytic strength of 2.5×105 V/cm, a temperature of 25° C., and the relative humidity of 50% by X-TOF mode of a drum checker (CYNCYA manufactured by GEN-TECH, Inc.).

Also, the photoconductors of Examples 5 to 11 and Comparative Example 2 as produced above were respectively disposed with commercially available digital copying machines AR-C150 (trade name, manufactured by Sharp Corp.) which were adapted as test machines having 117 mm/second of rotational speed of the photoconductor, and the printing durability, the electrical properties and the environmental stability of each photoconductor were evaluated as below. Incidentally, the digital coping machine AR-C150 is a negative charge-type of the image forming apparatus for electrophotographic processing by negatively charging the photoconductor surface.

(a) The printing durability

By using the test copying machine, a test image of the predesigned pattern was formed on 40,000 sheets of recording paper, and then the thickness d1 [μm] of the photosensitive layer was measured after removing the disposed photoconductor from the test machine, and a subtracted value (d0–d1) was calculated as an amount of a reduced thickness Δd by subtracting the value d1 from the value d0 of the thickness of the photosensitive layer at the time of forming the photosensitive layer in order to set indexes for evaluation of the printing durability. Incidentally, the thickness was measured by a light interference method using a momentary multi-light measurement system MCPD-1100 (trade name, manufactured by Otsuka Electronics Co., Ltd.).

(b) The electrical properties and the environmental stability

A surface potentiometer (CATE 751 manufactured by GEN-TECH, Inc.) was installed in the inside of the copying machine to measure the surface potential of the photoconductor during the formation of an image. By using the copying machine, the surface potential of each photoconductor was measured as the charging potential V1 [V] immediately after charging the photoconductors by the charging apparatus, in an environment of N/N of 22° C. and at 65% relative humidity. Also, the surface potential of the photoconductor was measured as the residual potential VL [V] immediately after exposing the photoconductor by a laser beam in order to set a residual potential $VL_N$ in an environment of N/N. As the absolute value of the charging potential V1 is higher, the chargeability was evaluated as better, and as the absolute value of the residual potential $VL_N$ is lower, the photo-response was evaluated as better.

Further, the residual potential VL [V] was measured in an environment of L/L of 5° C. and at 20% relative humidity under the same conditions as the case of the environment of N/N in order to set a residual potential $VL_L$. The absolute value ($|VL_L-VL_N|$) was obtained as an electrical potential change ΔVL by subtracting the residual potential $VL_N$ in the environment of N/N from the residual potential $VL_L$ in the environment of L/L. As the potential change ΔVL was lower, the stability of the electrical properties was evaluated as better.

These evaluation results are shown in Table 3.

| | charge transporting material | charge transporting material/ binder resin | reduced thickness Δd (μm) | N/N-electrical potential properties $V_1$ (V) | $V_L$ (V) | L/L-electrical potential change $\Delta V_L$ (V) | Hall mobility ($cm^2/V \cdot sec$) |
|---|---|---|---|---|---|---|---|
| Ex 5 | Ex Compd 4 | 10/20 | 2.5 | −548 | −52 | 32 | $1.1 \times 10^{-4}$ |
| Ex 6 | Ex Compd 15 | 10/20 | 2.6 | −543 | −51 | 31 | $3.4 \times 10^{-5}$ |
| Ex 7 | Ex Compd 33 | 10/20 | 2.4 | −540 | −53 | 37 | $7.2 \times 10^{-5}$ |
| Comp Ex 2 | Comp Compd A | 10/20 | 4.5 | −535 | −110 | 80 | $6.8 \times 10^{-6}$ |
| Ex 8 | Ex Compd 4 | 10/25 | 1.9 | −537 | −60 | 39 | — |
| Ex 9 | Ex Compd 15 | 10/25 | 1.8 | −530 | −63 | 41 | — |
| Ex 10 | Ex Compd 33 | 10/25 | 1.8 | −510 | −62 | 43 | — |
| Ex 11 (Ref Ex 1) | Ex Compd 4 | 10/10 | 11.6 | −530 | −24 | 20 | — |
| Ref Ex 2 | Ex Compd 4 | 10/31 | — | — | — | — | — |

The compound of the present invention represented by the general formula (1) was found to have one or more digits higher charge mobility compared with triphenylamine daimer (TPD) of Comparative Compound A according to the comparison between Examples 5 to 7 and Comparative Example 2.

The photoconductor using the compound of the present invention represented by the general formula (1) as the charge transporting substance was found to have the low absolute value of the residual potential $VL_N$ in the environment of N/N compared with the photoconductor of Comparative Example 2 using Comparative Compound A as the charge transporting substance according to the comparison between Examples 5 to 10 and Comparative Example 2. As a result, the photoconductors of Examples 5 to 10 were found to have the excellent photo-response even though a ratio between the weight of the binder resin and the weight of the charge transporting substance of the charge transporting layer (the binder resin/the charge transporting substance) is 1.2 or higher. Also, the photoconductors of Examples 5 to 10 were found to be excellent in the environmental stability due to a low value of the electrical potential change ΔVL and to have the sufficient photo-response even in the environment of L/L, compared with the photoconductor of Comparative Example 2.

Also, the photoconductors of Examples 5 to 10 in which a ratio (B/A) between the weight of the binder resin (B) and the weight of the compound (A) of the present invention represented by the general formula (1) was within a range of 1.2 to 3.0 were found to have the lower amount of the reduced thickness Δd and to be excellent in the printing durability compared with the photoconductor of Example 11 in which the ratio B/A was lower than 1.2, according to the comparison between Examples 5 to 10 and Example 11.

As described above, the printing durability of the charge transporting layer was improved without lowering the photo-response by forming the charge transporting layer containing the organic photoconductive material of the present invention.

According to the present invention, the charge transporting substance having a structure formed of expanded a conjugated system is used since it has the structure represented by the above general formula (1), (2) or (3) as the charge transporting material, that is, three stilbene structures or butadiene structures in a molecule. The photosensitive layer having the high charging potential, the high sensitivity, the sufficient photo-response, and the high hale-transporting capability can be obtained by causing the photosensitive layer to contain the charge transporting substance as the organic photoconductive material.

The electrophotographic photoconductor having the high durability as a result of increasing the amount of the binder resin by using the charge transporting substance which indicates the high hale-transporting capability for the photosensitive layer and having the high reliability without lowering the above properties even using the charge transporting substance in the low temperature environment or the high-speed process, and the image forming apparatus using the electrophotographic photoconductor can be obtained. Also, if the charge transporting substance is used for the sensor material, the EL element, or the static recording element, a device having an excellent response can be obtained.

What is claimed is:

1. An electrophotographic photoconductor provided with a conductive support comprising a conductive material; and a photosensitive layer containing a charge generating substance provided on the conductive support and containing a charge transporting substance as a charge transporting material, in which the charge transporting substance is represented by the general formula (1):

(1)

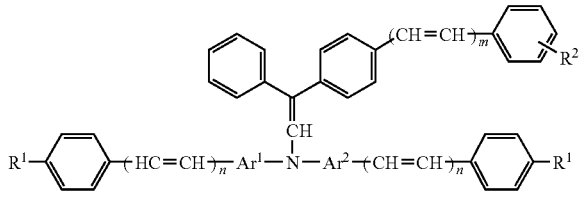

wherein $Ar^1$ and $Ar^2$ represent, independently of each other, an arylene group which may have substituent(s), $R^1$ represents an alkyl or alkoxy group which may have substituent(s), $R^2$ represents a hydrogen atom, an alkyl or alkoxy group which may have substituent(s), and n and m represent 1 or 2.

2. The electrophotographic photoconductor according to claim 1, wherein the charge transporting substance is represented by the following general formula (2):

(2)

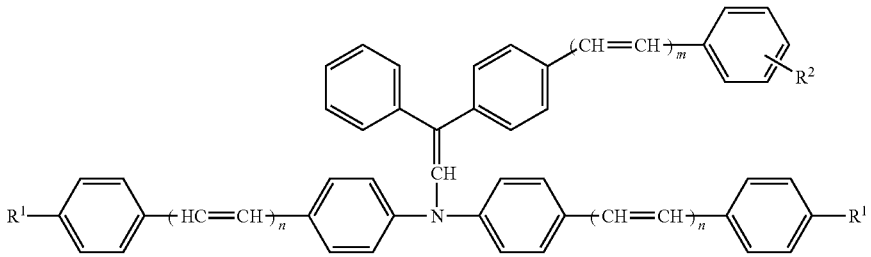

wherein $R^1$, $R^2$, n and m have the same meanings as defined in the above general formula (1), in which each of $Ar^1$ and $Ar^2$ in the above general formula (1) are a phenylene group.

3. The electrophotographic photoconductor according to claim 1, wherein the charge transporting substance is represented by the following general formula (3):

(3)

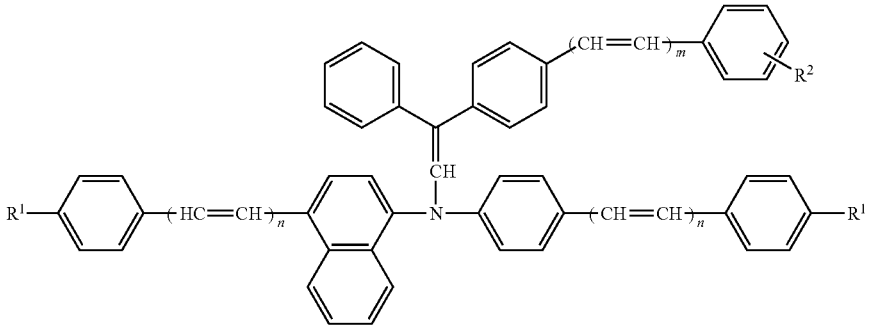

wherein $R^1$, $R^2$, n and m have the same meanings as defined in the above general formula (1), in which one of $Ar^1$ and $Ar^2$ in the above general formula (1) is a phenylene group and the other is a naphthylene group.

4. The electrophotographic photoconductor according to claim 1, wherein oxotitanium phthlocyanine is contained as the charge generating substance, which has at least 27.20 of diffraction peak at a Bragg angle (2θ±0.2°) in Cu—Ku characteristic X-ray diffraction (wavelengths: 1.54 Å).

5. The electrophotographic photoconductor according to claim 1, wherein the photosensitive layer comprises a layered structure having a charge generating layer containing the charge generating substance; and a charge transporting layer containing the charge transporting substance.

6. The electrophotographic photoconductor according to claim 1 wherein the charge transporting layer further contains a binder resin, and a weight ratio A/B between the charge transporting substance (A) and the binder resin (B) in the charge transporting layer is 10/12 to 10/30.

7. The electrophotographic photoconductor according to claim 1, wherein an intermediate layer is provided between the conductive support and the photosensitive layer.

8. An image forming apparatus with the electrophotographic photoconductor according to claim 1.

* * * * *